US009588484B2

(12) United States Patent
Sato

(10) Patent No.: US 9,588,484 B2
(45) Date of Patent: Mar. 7, 2017

(54) IMAGE-FORMING APPARATUS PROVIDED WITH GUIDE FOR GUIDING MOVEMENT OF DEVELOPING CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/007,439

(22) Filed: Jan. 27, 2016

(65) Prior Publication Data

US 2016/0216686 A1 Jul. 28, 2016

(30) Foreign Application Priority Data

Jan. 27, 2015 (JP) ..... 2015-013549

(51) Int. Cl.
*G03G 21/16* (2006.01)

(52) U.S. Cl.
CPC ..... *G03G 21/1676* (2013.01); *G03G 21/1647* (2013.01)

(58) Field of Classification Search
CPC ..... G03G 21/1676; G03G 21/1647; G03G 21/1633; G03G 21/16; G03G 2221/163; G03G 2221/16; G03G 21/1842
See application file for complete search history.

(56) References Cited

U.S. PATENT DOCUMENTS 8,886,081 B2 11/2014 Yokota
2006/0140673 A1* 6/2006 Kamimura ..... G03G 15/01 399/119
2012/0070185 A1 3/2012 Yokota
2012/0183321 A1* 7/2012 Mori ..... G03G 21/1633 399/110

FOREIGN PATENT DOCUMENTS

JP 2012-068371 A 4/2012

* cited by examiner

*Primary Examiner* — Sandra Brase
(74) *Attorney, Agent, or Firm* — Banner & Witcoff, Ltd.

(57) ABSTRACT

An image-forming apparatus includes: a photosensitive drum; a developing cartridge including a developing roller; a developing pressing member for pressing the developing cartridge; a first developing guide; and a second developing guide. The developing cartridge is movable among a detachable position; a contact position at which the developing roller contacts the photosensitive drum; and a separated position at which the developing roller is separated from the photosensitive drum. The developing pressing member presses the developing cartridge to place the developing cartridge at the contact position. The developing pressing member is disabled from pressing the developing cartridge to place the developing cartridge at the separated position lower than the contact position. The first developing guide can guide movement of the developing cartridge between the detachable position and the contact position. The second developing guide can guide movement of the developing cartridge between the contact position and the separated position.

19 Claims, 14 Drawing Sheets

RIGHT
FRONT
REAR
LEFT
A
B

RIGHT
FRONT
REAR
LEFT

RIGHT
FRONT
REAR
LEFT

IMAGE-FORMING APPARATUS PROVIDED WITH GUIDE FOR GUIDING MOVEMENT OF DEVELOPING CARTRIDGE

CROSS REFERENCE TO RELATED APPLICATION

This application claims priority from Japanese Patent Application No. 2015-013549 filed Jan. 27, 2015. The entire content of the priority application is incorporated herein by reference.

TECHNICAL FIELD

The present disclosure relates to an electro-photographic type image-forming apparatus.

BACKGROUND

There has been proposed an image-forming apparatus that includes a main housing, a photosensitive drum supported to the main housing, and a cartridge provided with a developing roller. The cartridge is attached to and detached from the main housing.

As one of such image-forming apparatus, Japanese Patent Application Publication No. 2012-68371 discloses an image-forming device including: a cartridge having a positioning boss protruding outward in an axial direction of a developing roller; and a main housing formed with a receiving groove adapted to guide the positioning boss, so that the cartridge can be attached to the main housing. An urging member is provided in the receiving groove for urging the positioning boss toward downstream in a cartridge attaching direction so that the developing roller is brought into abutment with the photosensitive drum.

SUMMARY

However, in the above-described image-forming apparatus, since the urging member is provided at a midway of the receiving groove, the positioning boss of the cartridge may not be sufficiently urged if the urging force of the urging member gets lowered. Thus, the cartridge may be dropped down along the receiving groove.

In view of the foregoing, it is an object of the present disclosure to provide an image-forming apparatus capable of restraining dropping down of the developing cartridge.

In order to attain the above and other objects, the disclosure provides an image-forming apparatus including: a photosensitive drum; a developing cartridge including a developing roller; a first developing guide; a developing pressing member; and a second developing guide. The developing cartridge is movable between a detachable position at which the developing cartridge is detachable from the image-forming apparatus and a contact position at which the developing roller is in contact with the photosensitive drum, the developing cartridge being further movable between the contact position and a separated position at which the developing roller is separated from the photosensitive drum. The developing cartridge is positioned lower when at the separated position than at the contact position. The first developing guide is configured to guide movement of the developing cartridge between the detachable position and the contact position. The developing pressing member is configured to press the developing cartridge in such a direction that the developing roller is pressed toward the photosensitive drum, the developing pressing member pressing the developing cartridge to place the developing cartridge at the contact position, the developing pressing member being disabled from pressing the developing cartridge to place the developing cartridge at the separated position. The second developing guide is configured to guide movement of the developing cartridge between the contact position and the separated position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, a printer 1 as an example of an image-forming apparatus according to an embodiment will be described while referring to FIGS. 1 through 14.

1. Overall Structure of the Printer

In the following description, directions will be based on an assumption that the printer 1 is disposed in a horizontal orientation in which it is intended to be used. Specifically, the right side of FIG. 1 will be called the "front," the left side will be called the "rear." Further, the left side and right side of the printer 1 are defined when viewing the printer 1 from its front side. That is, the near side in FIG. 1 will be called the "left," and the far side will be called the "right." Further, the "top" and "bottom" of the printer 1 will correspond to the vertical direction in FIG. 1.

Figure 1:
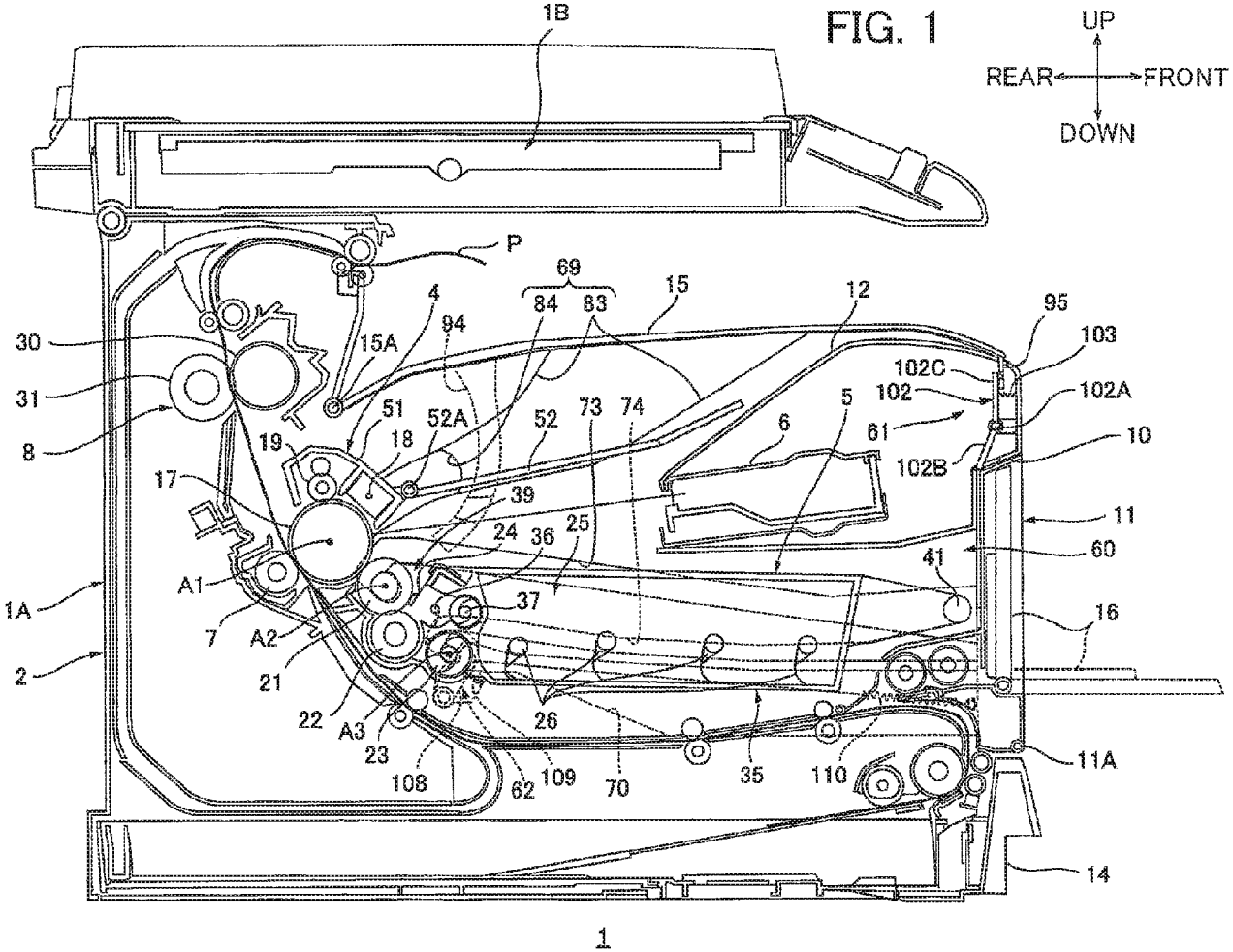
FIG. 1 is a cross-sectional view of a printer which is an example of an image-forming apparatus according to an embodiment.

The printer 1 is an electro-photographic type monochromatic printer. As shown in FIG. 1, the printer 1 includes an image-forming unit 1A for forming an image on a sheet P, and an image-reading unit 1B for reading an image of an original document.

The image-forming unit 1A constitutes a lower half portion of the printer 1. The image-forming unit 1A includes a main casing 2, a drum cartridge 4, a developing cartridge 5, an exposure unit 6, a transfer roller 7, and a fixing unit 8.

The main casing 2 is generally box-shaped, and is formed with a first opening 10 and a second opening 12. The first opening 10 is formed in a front end portion of the main casing 2 to penetrate therethrough in a front-rear direction for allowing the developing cartridge 5 to pass through the first opening 10. The second opening 12 is formed in an upper end portion of the main casing 2 to penetrate therethrough in an up-down direction for allowing the drum cartridge 4 to pass through the second opening 12.

The main casing 2 is provided with a first cover 11, a sheet supply tray 14, and a second cover 15.

The first cover 11 is provided at the front end portion of the main casing 2 for closing the first opening 10. The first cover 11 is plate-shaped extending in the up-down direction when the first cover 11 closes the first opening 10. The first cover 11 has a lower end portion provided with a first cover shaft 11A, and is pivotally movable about an axis of the first cover shaft 11A between a first open position (see FIG. 9) opening the first opening 10 and a first closed position (see FIG. 1) closing the first opening 10 via an intermediate position (see FIG. 6).

The first cover 11 is provided with a manual insertion tray 16. The manual insertion tray 16 is movable about its lower end portion between a tilting position (as shown by a dotted line in FIG. 1) for allowing a sheet to be placed on the manual insertion tray 16 and a retracted position (as shown by a solid line in FIG. 1) at which the manual insertion tray 16 is retracted in the first cover 11 in superposed relation thereto.

The sheet supply tray 14 is positioned at a bottom end portion of the main casing 2, and is configured to accommodate sheets P.

The second cover 15 is provided at the upper end portion of the main casing 2 for closing the second opening 12. The sheets P discharged out of the main casing 2 are configured to be placed on the second cover 15 closing the second opening 12. The second cover 15 is generally plate-shaped extending in the front-rear direction when the second cover 15 closes the second opening 12. The second cover 15 has a rear end portion provided with a second cover shaft 15A, and is pivotally movable about an axis of the second cover shaft 15A between a second open position (see FIG. 12) opening the second cover 12 and a second closed position (see FIG. 1) closing the second opening 12.

The drum cartridge 4 is positioned at a generally center portion of the main casing 2. The drum cartridge 4 is attachable to and detachable from the main casing 2 through the second opening 12. The drum cartridge 4 includes a photosensitive drum 17, a scorotron charger 18, and a cleaning roller 19.

The photosensitive drum 17 is generally cylindrical extending in a left-right direction. The photosensitive drum 17 has a central axis A1 about which the photosensitive drum 17 is rotatable. The central axis A1 is an example of an axis of a photosensitive drum. The photosensitive drum 17 is supported to a rear end portion of the drum cartridge 4.

The scorotron charger 18 is positioned diagonally frontward and upward of the photosensitive drum 17 and is spaced away from the photosensitive drum 17.

The cleaning roller 19 is positioned above the photosensitive drum 17, and has a lower end portion in contact with an upper end portion of the photosensitive drum 17.

The developing cartridge 5 is positioned forward of and diagonally downward of the drum cartridge 4. The developing cartridge 5 is configured to be attached to and detached from the main casing 2 through the first opening 10. The developing cartridge 5 includes a developing roller 21, a supply roller 22, a conveying member 23, a thickness regulation blade 24, and a toner chamber 25.

The developing roller 21 is provided at a rear end portion of the developing cartridge 5. The developing roller 21 has a central axis A2 about which the developing roller 21 is rotatable. The central axis A2 is an example of an axis of a developing roller. The developing roller 21 has an upper-rear end portion in contact with a lower-front end portion of the photosensitive drum 17. That is, the central axis A2 of the developing roller 21 is positioned lower than the central axis A1 of the photosensitive drum 17.

The supply roller 22 is positioned diagonally frontward and downward of the developing roller 21. The supply roller 22 has an upper end portion in contact with a lower end portion of the developing roller 21.

The conveyer member 23 is positioned frontward of and downward of the supply roller 22. The conveyer member 23 is an auger screw extending in the left-right direction, and defines a central axis A3 about which the conveying member 23 is rotatable.

The thickness regulation blade 24 is positioned frontward of the developing roller 21, and is in contact with a front end portion of the developing roller 21.

The toner chamber 25 is positioned frontward of the conveyer member 23 and the thickness regulation blade 24. The toner chamber 25 is generally box-shaped elongated in the front-rear direction and is configured to accommodate toner therein. Four agitators 26 are provided in the toner chamber 25.

The four agitators 26 are arrayed with a space between neighboring agitators in the front-rear direction. The agitators 26 are rotatably supported in the toner chamber 25.

The exposure unit 6 is positioned at an upper-front end portion in the main casing 2 at a position frontward of the photosensitive drum 17 and upward of the front portion of the developing cartridge 5. In other words, the exposure unit 6 is overlapped with a part of the photosensitive drum 17 when viewed in the front-rear direction. The exposure unit 6 is configured to irradiate a laser beam to the photosensitive drum 17 based on image data.

The transfer roller 7 is provided at a position rearward and downward of the photosensitive drum 17. The transfer roller 7 has a front upper end portion in contact with a rear lower end portion of the photosensitive drum 17.

The fixing unit 8 is positioned rearward and upward of the transfer roller 7 and the drum cartridge 4. The fixing unit 8 includes a heat roller 30 and a pressure roller 31 in pressure contact with a rear end portion of the heat roller 30.

The image-reading unit 1B is positioned above the image-forming unit 1A so as to cover the second cover 15 from above. That is, the image-reading unit 1B is positioned adjacent to the main casing 2 at a downstream side thereof in a moving direction of the second cover 15 from the second closed position to the second open position. The image-reading unit 1B has a rear pivot portion pivotally movably connected to an upper-rear end portion of the image-forming unit 1A, so that the image-reading unit 1B is pivotally movable about the rear pivot portion.

Upon start of an image forming operation in the printer 1, the scorotron charger 18 applies a uniform charge to the surface of the photosensitive drum 17, after which the exposure unit 6 irradiates a laser beam to expose the surface of the photosensitive drum 17 to light for forming an electrostatic latent image thereon based on image data.

The four agitators 26 agitate the toner accommodated in the toner chamber 25 and convey the toner rearward. The conveyer member 23 then conveys the toner supplied to the rear portion of the toner chamber 25 in the left-right direction. The supply roller 22 then supplies the toner to the developing roller 21, at which time the toner is tribo-charged between the developing roller 21 and the supply roller 22, so that the toner with positive polarity is carried on the developing roller 21. Then, the thickness regulation blade 24 regulates a thickness of the toner layer on the developing roller 21 into a uniform thickness.

The toner carried on the developing roller 21 is then supplied to the electrostatic latent image formed on the surface of the photosensitive drum 17. Thus, the electrostatic latent image is developed into a visible toner image and carried on the surface of the photosensitive drum 17.

Each sheet P is successively conveyed from the sheet supply tray 14 to a position between the photosensitive drum 17 and the transfer roller 7 by various rollers at a prescribed timing. The toner image formed on the photosensitive drum 17 is transferred onto the sheet P when the sheet P passes through the position between the photosensitive drum 17 and the transfer roller 7.

Then, the toner image transferred onto the sheet P is applied with heat and pressure when the sheet P passes between the heat roller 30 and the pressure roller 31. Thus, the toner image on the sheet P is thermally fixed to the sheet P. Then, the sheet P is discharged out of the main casing 2 and is placed on the second cover 15 positioned at its second closed position.

2. Detailed Structure of the Developing Cartridge

Figure 2A:
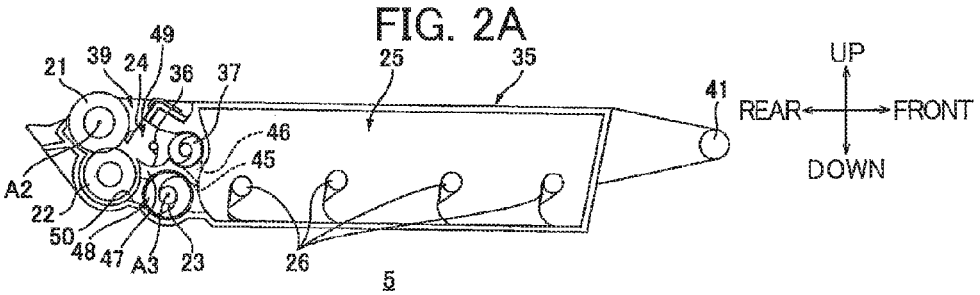
FIG. 2A is a cross-sectional view of a developing cartridge assembled in the printer of FIG. 1.

As illustrated in FIG. 2A, the developing cartridge 5 further includes a developing frame 35, a returning blade 36, and a returning member 37.

Figure 2B:
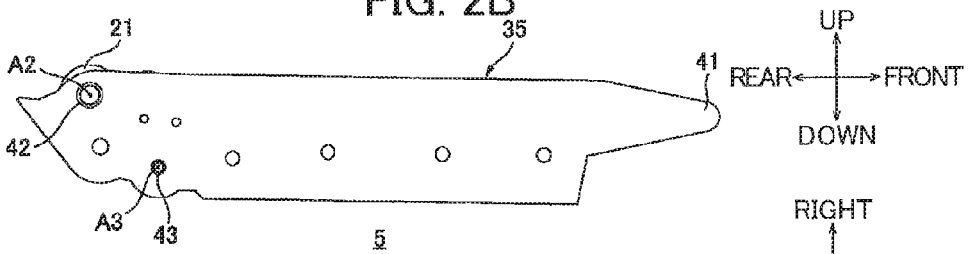
FIG. 2B is a side view of the developing cartridge.
Figure 2C:
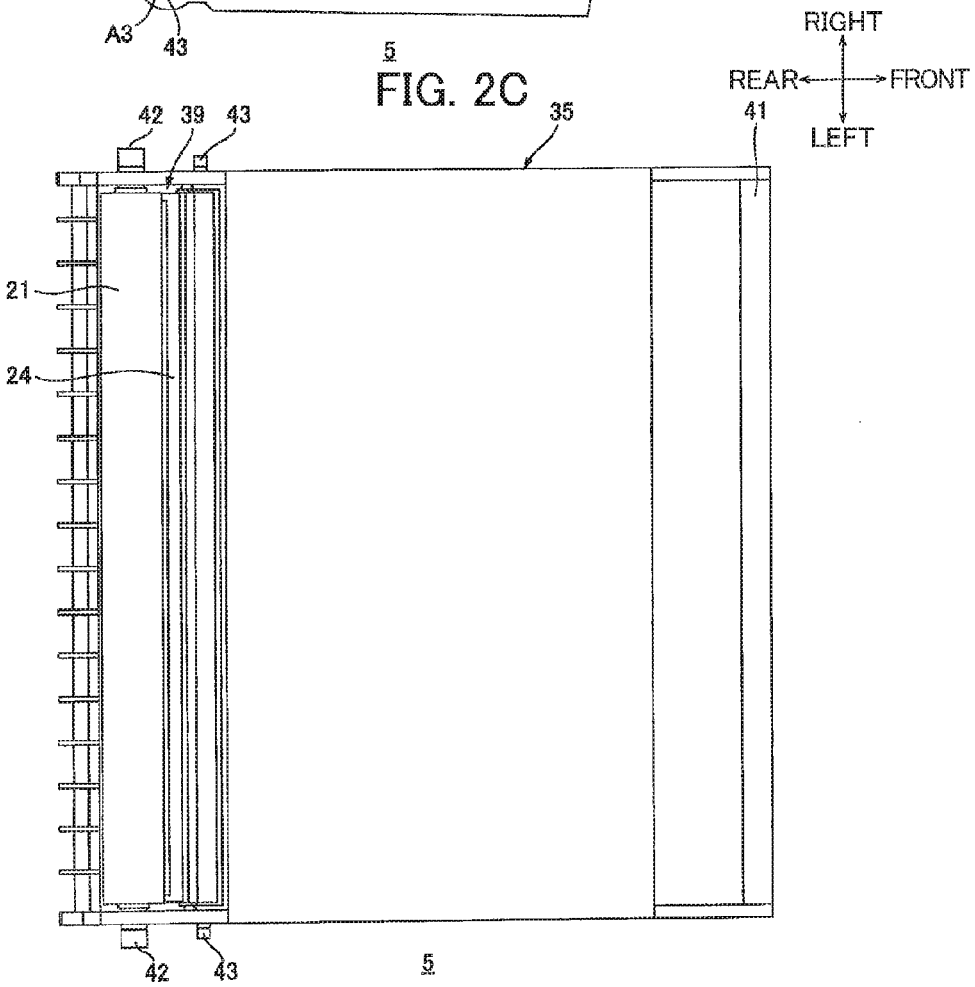
FIG. 2C is a plan view of the developing cartridge.

As illustrated in FIGS. 2A and 2C, the developing frame 35 includes the toner chamber 25, a developing part 39, a developing grip part 41, a pair of first protrusions 42, and a pair of second protrusions 43.

The toner chamber 25 constitutes a substantially center portion of the developing frame 35 in the front-rear direction. The toner chamber 25 extends in the left-right direction and has a substantially rectangular cylindrical shape with its left and right ends closed. As illustrated in FIG. 2A and described above, the toner chamber 25 supports the four agitators 26 therein. Further, the toner chamber 25 is formed with a first supply port 45 and a return port 46.

The first supply port 45 is formed in a lower-rear end portion of the toner chamber 25. The first supply port 45 penetrates a rear wall defining the toner chamber 25 in the front-rear direction.

The return port 46 is formed at a substantially center of the rear end portion defining the toner chamber 25 in the up-down direction. The return port 46 penetrates the rear wall of the toner chamber 25 in a direction connecting between lower-front and upper-rear thereof.

The developing part 39 is connected to the toner chamber 25 to extend rearward therefrom and constitutes a rear end portion of the developing frame 35. The developing part 39 has a substantially semi-rectangular cylindrical shape with its upper end open and with both left and right ends thereof closed. The developing part 39 supports the developing roller 21 so as to be exposed through the open upper end. Further, the developing part 39 includes a partition plate 47 that partitions an internal space within the developing part 39 into a supply chamber 48 and a returning chamber 49.

The partition plate 47 has a substantially L-shaped plate shape in a side view. Specifically, the partition plate 47 protrudes backward from the substantial center of a front wall of the developing part 39 in the up-down direction, is then bent downward, and is connected to a substantial front-rear center of a bottom wall of the developing part 39. The partition plate 47 extends in the left-right direction and spans across the entire area of the developing part 39 in the left-right direction. The partition plate 47 includes a second supply port 50.

The second supply port 50 is formed in a rear portion of the partition plate 47 to penetrate the same in the front-rear direction.

The supply chamber 48 is a space enclosed by the partition plate 47 and developing frame 35 and constitutes a lower-front end portion of the developing part 39. The supply chamber 48 has its front end in communication with the toner chamber 25 through the first supply port 45, while its rear end exposed to the supply roller 22 through the second supply port 50. The supply chamber 48 accommodates the conveying member 23 therein.

The returning chamber 49 is a space enclosed by the partition plate 47, developing roller 21, supply roller 22, and thickness regulation blade 24 and constitutes an upper-front end portion of the developing part 39. The returning chamber 49 is in communication with the toner chamber 25 through the return port 46.

As illustrated in FIGS. 2A and 2C, the developing grip part 41 has a substantial U-shape that is open rearward in a top view, and has both left and right rear ends connected to both left and right front ends of the developing frame 35.

As illustrated in FIGS. 2B and 2C, the pair of first protrusions 42 has a substantially cylindrical shape and shares the central axis A2 of the developing roller 21 as its central axis. The protrusions 42 protrude outward in the left-right direction from respective left and right side walls of the developing frame 35. The first protrusions 42 rotatably support a rotational shaft of the developing roller 21.

The pair of second protrusions 43 has a substantially cylindrical shape and shares the center axis A3 of the conveying member 23 as its center axis. The second protrusions 43 protrude outward in the left-right direction from respective left and right side walls of the developing frame 35 The second protrusion 43 has a diameter smaller than a diameter of the first protrusion 42. Further, as illustrated in FIG. 2C, the second protrusions 43 are positioned inward of the respective protrusions 42 in the left-right direction. The second protrusions 43 rotatably support a rotational shaft of the conveying member 23.

The returning blade 36 is disposed frontward of and downward of the thickness regulation blade 24 in the returning chamber 49. The returning blade 36 is configured to convey the toner scraped off the developing roller 21 by the thickness regulation blade 24.

The returning member 37 is disposed frontward of the returning blade 36 in the returning chamber 49. The returning member 37 is an auger screw that extends in the left-right direction. The returning member 37 is configured to convey the toner conveyed from the returning blade 36 in the left-right direction and to return the toner into the toner chamber 25 through the return port 46.

The developing cartridge 5 is movable among a detachable position (see FIG. 9) at which the developing cartridge 5 is attachable and detachable relative to the main casing 2, a contact position (see FIGS. 1 and 4) at which the developing roller 21 is in contact with the photosensitive drum 17, and a separated position (see FIG. 6) in which the developing roller 21 is separated from the photosensitive drum 17.

3. Detailed Structure of the Drum Cartridge

The drum cartridge 4 further includes a drum frame 51 and a drum grip part 52 (see FIG. 1).

The drum frame 51 has a substantial box shape that is open downward. The drum frame 51 supports the photosensitive drum 17.

Figure 3:
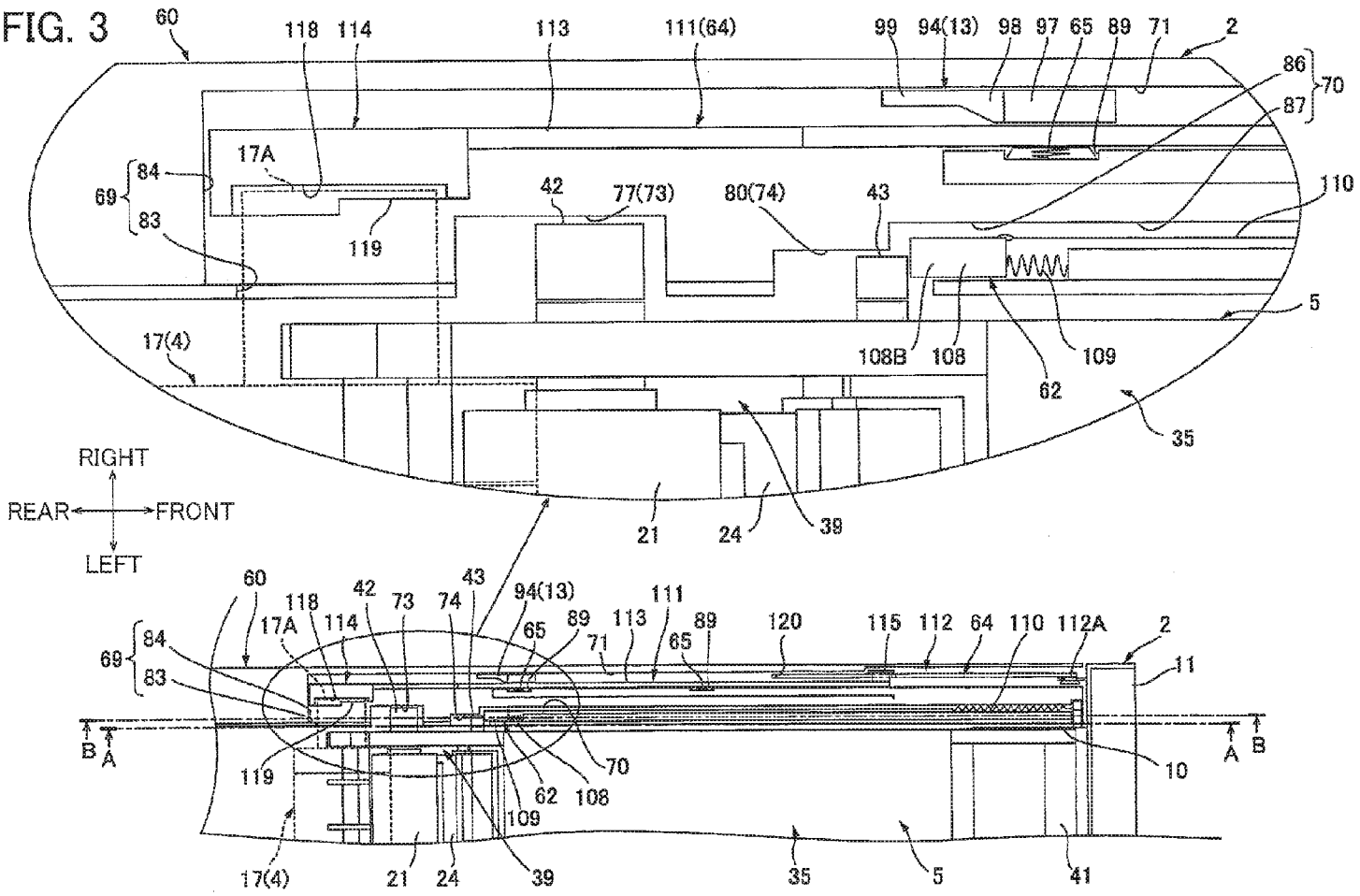
FIG. 3 is a view for description of a state of a drum cartridge and the developing cartridge those used in the printer of FIG. 1.

Specifically, the photosensitive drum 17 is supported such that a lower half thereof is exposed from the drum frame 51. As illustrated in FIG. 3, the photosensitive drum 17 has both end portions 17A in the left-right direction that respectively penetrate left and right side walls of the drum frame 51 to protrude outward therefrom in the left-right direction.

As illustrated in FIG. 1, the drum frame 51 supports the scorotron charger 18 and cleaning roller 19.

The drum grip part 52 is disposed on a front end portion of the drum frame 51. The drum grip part 52 extends in the front-rear and left-right directions. The drum grip part 52 has a rear end portion provided with a drum grip shaft 52A. The drum grip part 52 is pivotably supported to the front end portion of the drum frame 51 so as to be pivotally movable about an axis of the drum grip shaft 52A. Although not illustrated in the drawings, the drum grip part 52 has a substantial U-shape in a plan view that is open rearward, that is, the side of the drum grip part 52 at which the drum grip shaft 52A is provided is opened.

The drum cartridge 4 is movable between an image-forming position (see FIGS. 1 and 4) at which the photosensitive drum 17 contacts the developing roller 21 to allow an image formation to be performed and a non-image-forming position (see FIG. 9) at which the photosensitive drum 17 is separated from the developing roller 21 to disable an image formation.

4. Detailed Structure of the Main Casing

As illustrated in FIGS. 1 and 3, the main casing 2 further includes a pair of side walls 60, a developing pressing mechanism 62, a linking unit 64, the second cover 15, two pairs of urging members 65, and a locking mechanism 61 as an example of a locking mechanism.

(1) Side Walls

The pair of side walls 60 is disposed so as to be separated from each other in the left-right direction. Since the pair of side walls 60 is bilaterally symmetric to each other, the right side wall 60 will be described, whereas the description of the left side wall 60 will be omitted.

Figure 4:
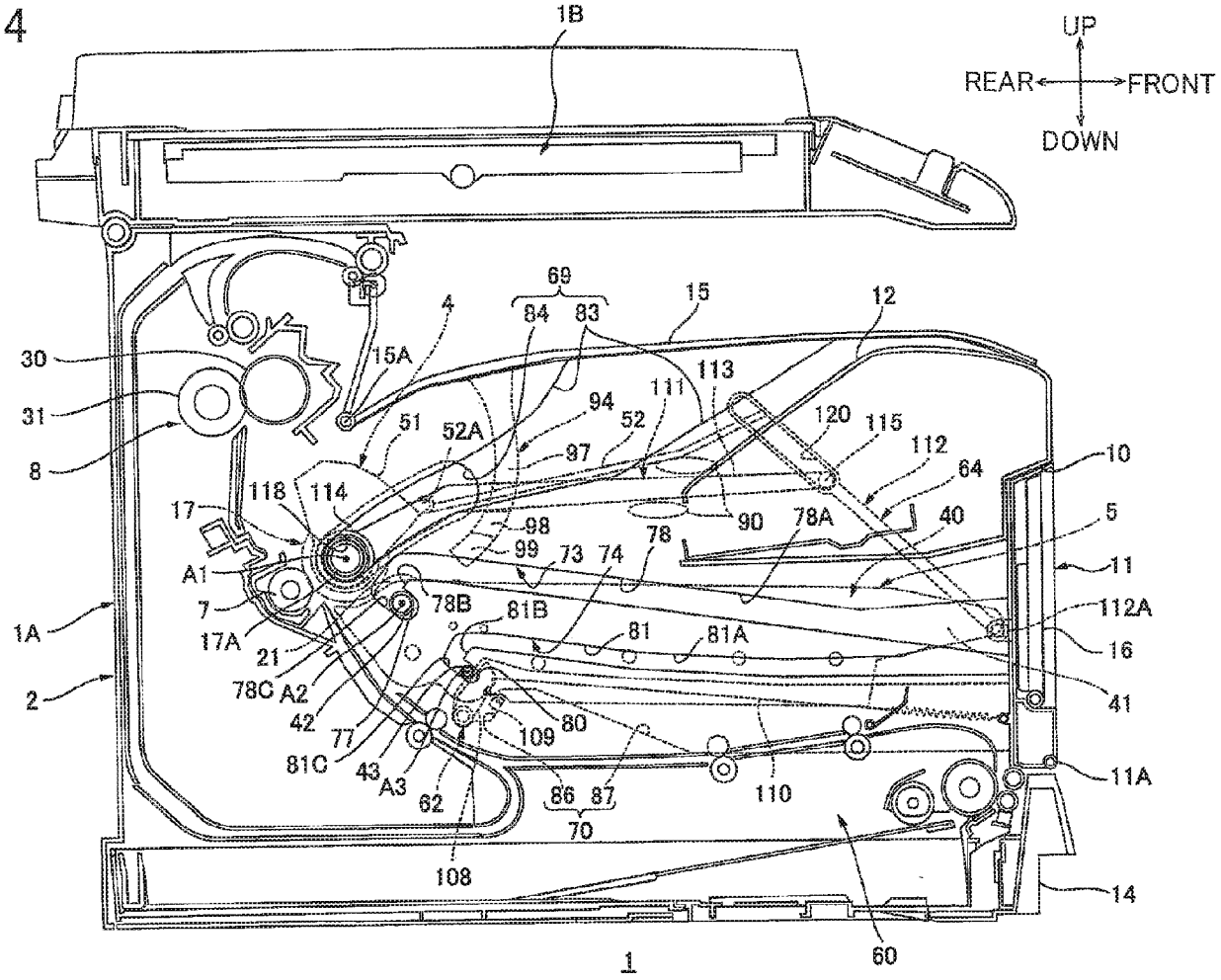
FIG. 4 is a cross-sectional view taken along a line A-A of FIG. 3 and showing a state where a first cover is at a first closed position and a second cover is at a second closed position in the printer according to the embodiment.
Figure 5:
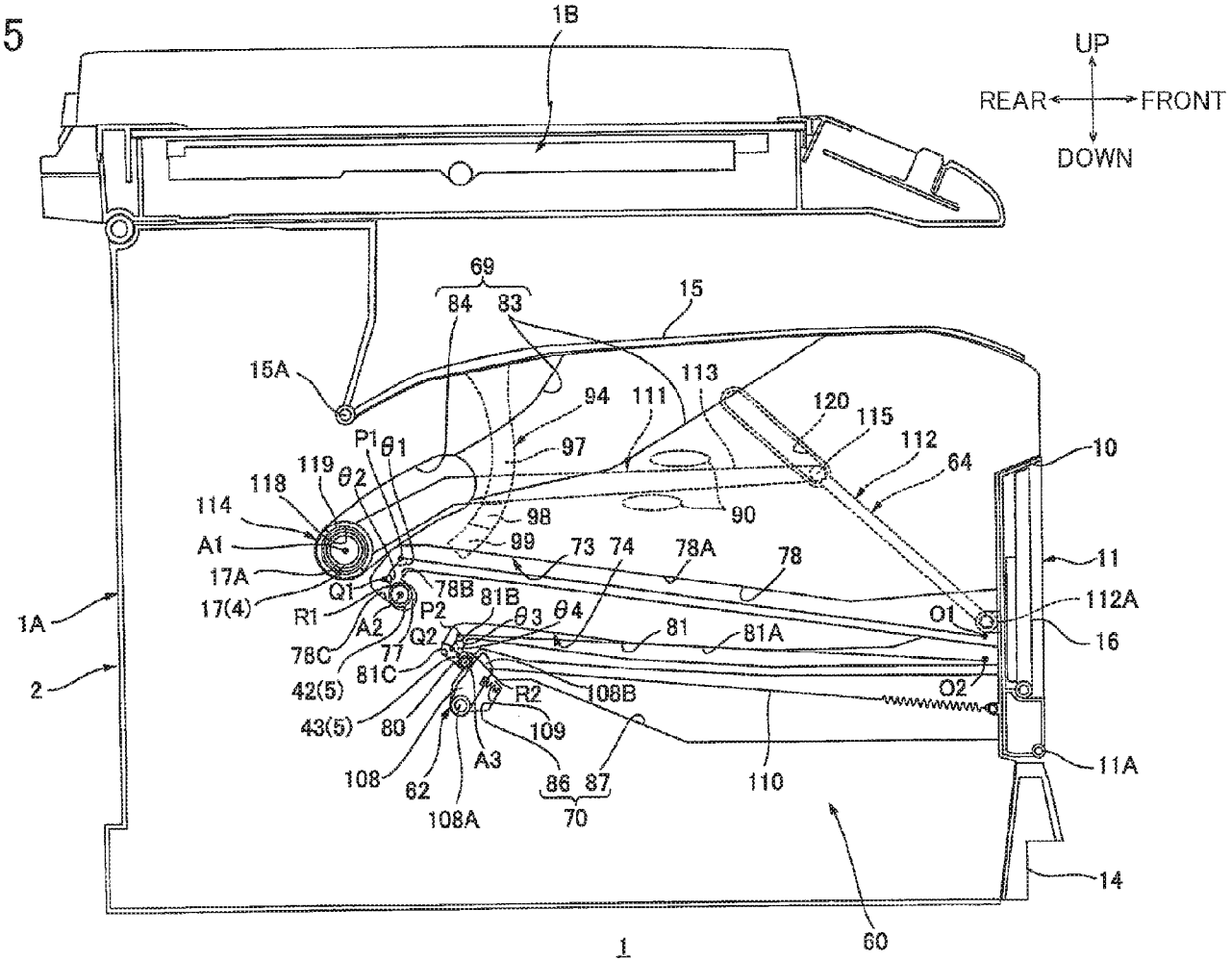
FIG. 5 is a cross-sectional view taken along a line B-B of FIG. 3 and showing a state where the first cover is at the first closed position and the second cover is at the second closed position in the printer according to the embodiment.

Referring to FIGS. 4 and 5, each side wall 60 includes a first cartridge guide 73, a second cartridge guide 74 disposed below the first cartridge guide 73, a drum guide 69, a pressing-mechanism accommodating section 70, a linking-unit accommodating section 71, two urging-member holding holes 89, and a pair of guide protrusions 90.

The first cartridge guide 73 is disposed at a substantial vertical center of the side wall 60. As illustrated in FIG. 3, the first cartridge guide 73 is recessed outward from an inner surface of the side wall 60 in the left-right direction. As shown in FIG. 5, the first cartridge guide 73 has a general V-shape that extends from the first opening 10 rearward while slightly extending upward, and is then bent diagonally forward and downward. Specifically, the first cartridge guide 73 includes a first developing guide 78 and a second developing guide 77.

The first developing guide 78 extends from a general vertical center of the first opening 10 toward the rear while extending slightly upward, is then bent downward at its rear end, and is connected to an upper-rear end of the second developing guide 77. More specifically, the first developing guide 78 includes a first portion 78A, a second portion 78B, and a third portion 78C.

The first portion 78A extends rearward while slightly going upward from the general vertical center of the first opening 10.

The second portion 78B extends and slopes from an upper-rear end of the first portion 78A diagonally rearward and downward.

The third portion 78C extends and slopes forward and downward from a rear lower end of the second portion 78B and is connected to the upper-rear end of the second developing guide 77.

Specifically, referring to FIG. 5, assume an imaginary polygon defined by: a line connecting a front lower end Q1 of the first portion 78A and a front upper end P1 of the second portion 78B; a line connecting the front upper end P1 of the second portion 78B and a rear upper end Q1 of the third portion 78C; a line connecting the rear upper end Q1 of the third portion 78C and a front lower end R1 of the third portion 78C; and a line connecting the front lower end R1 of the third portion 78C and the front lower end Q1 of the first portion 78A. In this imaginary polygon, an internal angle θ1 defined between the line connecting the front lower end Q1 of the first portion 78A and the front upper end P1 of the second portion 78B and the line connecting the front upper end P1 of the second portion 78B and the rear upper end Q1 of the third portion 78C is in a range from 70 to 110 degrees. That is, the first portion 78A and second portion 78B are connected to each other to form the internal angle θ1 ranging from of 70 to 110 degrees therebetween.

Likewise, in this imaginary polygon, an internal angle θ2 defined between the line connecting the front upper end P1 of the second portion 78B and the rear upper end Q1 of the third portion 78C and the line connecting the rear upper end Q1 of the third portion 78C and the front lower end R1 of the third portion 78C is in a range from 70 to 110 degrees. That is, the second portion 78B and third portion 78C are connected to each other to form the internal angle θ2 ranging from 70 to 110 degrees therebetween.

The second developing guide 77 extends forward and downward from the front lower end R1 of the third portion 78C. The second developing guide 77 extends in parallel to a direction connecting between the center axis A1 of the photosensitive drum 17 and the center axis A2 of the developing roller 21. The second developing guide 77 is configured to support the corresponding first protrusion 42 of the developing cartridge 5 attached to the main casing 2.

The front lower end Q1 of the first portion 78A is an example of a first end. The front upper end P1 of the second portion 78B is an example of a second end. The rear upper end Q1 of the third portion 78C is an example of a third end. The front lower end R1 of the third portion 78C is an example of a fourth end.

The second cartridge guide 74 is disposed below the first cartridge guide 73. As illustrated in FIG. 3, the second cartridge guide 74 is recessed outward from the inner surface of the side wall 60 in the left-right direction. The second cartridge guide 74 is recessed by a smaller amount than the first cartridge guide 73 is. In other words, the second cartridge guide 74 has a smaller dimension than the first cartridge guide 73 in the left-right direction. As illustrated in FIG. 5, the second cartridge guide 74 has a substantial V-shape extending rearward from the first opening 10 and then being bent forward and downward. Specifically, the second cartridge guide 74 includes a first developing guide 81 and a second developing guide 80.

The first developing guide 81 extends from the substantial vertical center of the first opening 10 toward the rear while extending slightly upward, is bent downward at the rear end thereof and is connected to an upper-rear end of the second developing guide 80. Specifically, the first developing guide 81 includes a first portion 81A, a second portion 81B, and a third portion 81C.

The first portion 81A extends rearward while slightly going upward from the substantial center of the first opening 10 in the up-down direction.

The second portion 81B extends and slopes rearward and downward from an upper-rear end of the first portion 81A.

The third portion 81C extends and slopes forward and downward from a lower-rear end of the second portion 81B and is connected to the upper-rear end of the second developing guide 80. The third portion 81C extends in the same direction as the second developing guide 80.

Specifically, referring to FIG. 5, assume an imaginary polygon defined by: a line connecting a front lower end Q2 of the first portion 81A and a front upper end P2 of the second portion 81B; a line connecting the front upper end P2 of the second portion 81B and a rear upper end Q2 of the third portion 81C; a line connecting the rear upper end Q2 of the third portion 81C and a front lower end R2 of the third portion 81C; and a line connecting the front lower end R2 of the third portion 81C and the front lower end Q2 of the first portion 81A. In this imaginary polygon, an internal angle θ3 defined between the line connecting the front lower end Q2 of the first portion 81A and the front upper end P2 of the second portion 81B and the line connecting the front upper end P2 of the second portion 81B and the rear upper end Q2 of the third portion 81C is in a range from 70 to 110 degrees. That is, the first portion 81A and second portion 81B are connected to each other to form the internal angle θ3 ranging from 70 to 110 degrees therebetween.

Likewise, in this imaginary polygon, an inner angle θ4 defined between the line connecting the front upper end P2 of the second portion 81B and the rear upper end Q2 of the third portion 81C and the line connecting the rear upper end Q2 of the third portion 81C and the front lower end R2 of the third portion 81C is in a range from 70 to 110 degrees. That is, the second portion 81B and third portion 81C are connected to each other to form the internal angle θ4 ranging from 70 to 110 degrees therebetween.

The front lower end Q2 of the first portion 81A is an example of the first end. The front upper end P2 of the second portion 81B is an example of the second end. The rear upper end Q2 of the third portion 81C is an example of the third end. The front lower end R2 of the third portion 81C is an example of the fourth end.

The second developing guide 80 extends diagonally forward and downward from the front lower end R2 of the third portion 81C. The second developing guide 80 is disposed frontward and downward of the second developing guide 77 of the first cartridge guide 73. The second developing guide 80 extends in parallel to the second developing guide 77.

The drum guide 69 is disposed above the first cartridge guide 73, as illustrated in FIGS. 4 and 5. The drum guide 69 includes a first drum guide 83 and a second drum guide 84.

The first drum guide 83 is recessed outward from the inner surface of the side wall 60 in the left-right direction, as illustrated in FIG. 3. The first drum guide 83 extends in a direction connecting the lower-rear and the upper-front, as illustrated in FIGS. 4 and 5. Specifically, the first drum guide 83 extends forward and upward from a position upward and rearward of the second developing guide 77 of the first cartridge guide 73, and is connected to the second opening 12. The first drum guide 83 has a front-rear dimension that becomes larger as extending upward and frontward.

As illustrated in FIG. 3, the second drum guide 84 is disposed in the side wall 60 at a position outward relative to the first drum guide 83 in the left-right direction. The second drum guide 84 overlaps a lower-rear end portion of the first drum guide 83 when projected in the left-right direction, as illustrated in FIGS. 4 and 5. The second drum guide 84 extends in a direction connecting the lower-rear and the upper-front. The second drum guide 84 has a dimension larger than a dimension of the lower-rear end portion of the first drum guide 83 in a direction connecting the lower-front and the upper-rear. That is, the second drum guide 84 has a larger width than the lower-rear end portion of the first drum guide 83.

The pressing-mechanism accommodating section 70 is disposed below the second cartridge guide 74. The pressing-mechanism accommodating section 70 is formed inside the side wall 60, as illustrated in FIG. 3. The pressing-mechanism accommodating section 70 is a space that extends in the front-rear direction, as illustrated in FIGS. 3 and 5. Specifically, the pressing-mechanism accommodating section 70 includes a pressing-member accommodating chamber 86 and a releasing-member accommodating chamber 87.

The pressing-member accommodating chamber 86 constitutes a rear end portion of the pressing-mechanism accommodating section 70. The pressing-member accommodating chamber 86 is formed at a position frontward of and downward of the second developing guide 80 of the second cartridge guide 74. The pressing-member accommodating chamber 86 is a space having a substantially rectangular shape in a side view. As illustrated in FIG. 3, the pressing-member accommodating chamber 86 has an inner end in the left-right direction that communicates with an outer end of the lower-front end of the second developing guide 80 in the left-right direction.

As illustrated in FIG. 5, the releasing-member accommodating chamber 87 extends rearward from a lower end portion of the first opening 10 and is connected to an upper end of the pressing-member accommodating chamber 86.

As illustrated in FIG. 3, the linking-unit accommodating section 71 is formed inside the side wall 60 at a position outward of the first cartridge guide 73, the second cartridge guide 74, and the pressing-mechanism accommodating section 70. Although not illustrated in the drawings, the linking-unit accommodating section 71 is a space that occupies an entire area above the first cartridge guide 73 in the side wall 60.

As illustrated in FIG. 3, the two urging-member holding holes 89 are formed in an inner surface defining the linking-unit accommodating section 71 in the left-right direction. The urging-member holding holes 89 are formed to be separated from each other in the front-rear direction. In a side view, the urging-member holding hole 89 on the rear is positioned in the vicinity of the upper-front end of the second drum guide 84, while the urging-member holding hole 89 on the front is in the vicinity of a rear end portion of the exposure unit 6. The urging-member holding holes 89 are recessed inward from the inner surface of the linking-unit accommodating section 71 in the left-right direction.

Figure 6:
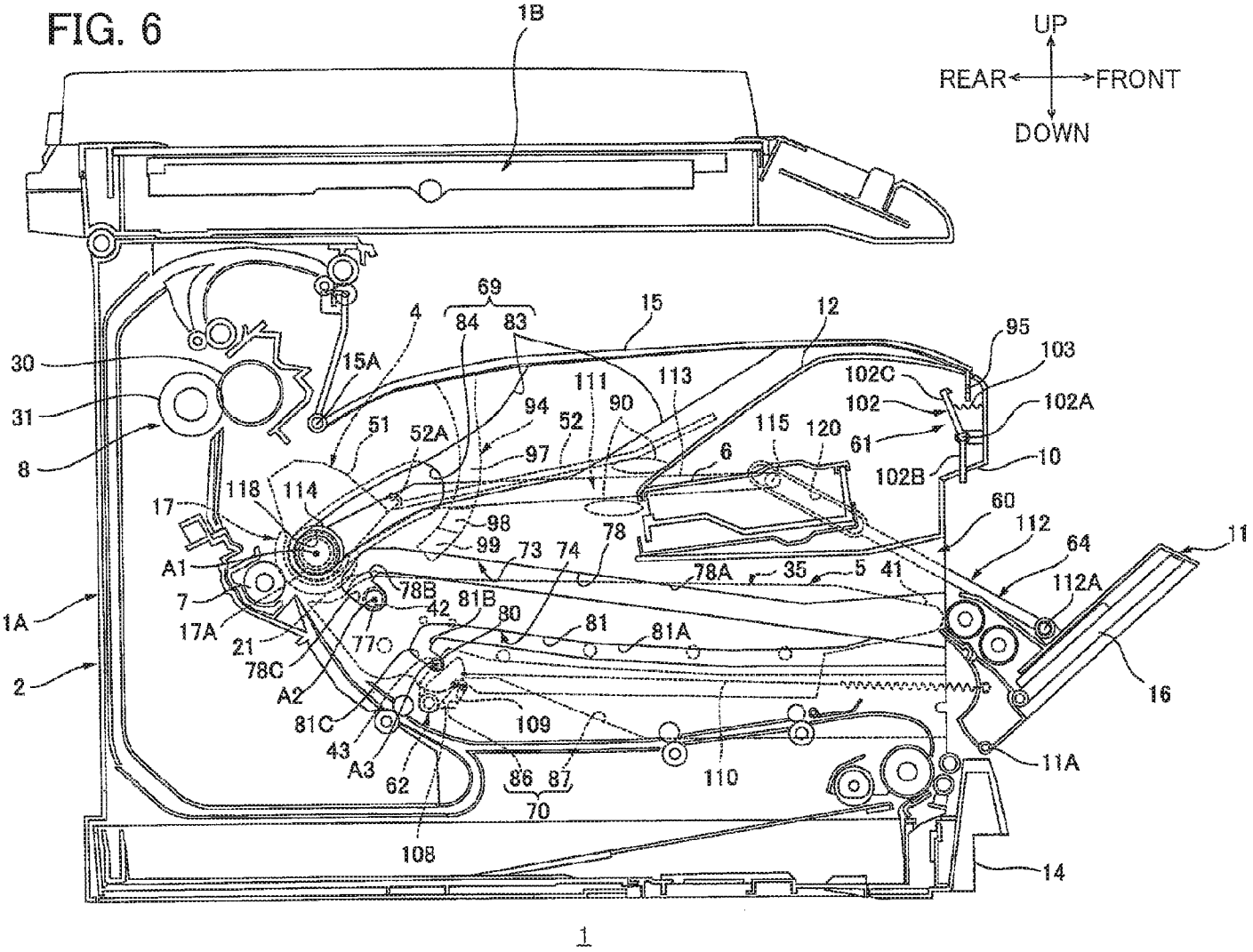
FIG. 6 is a cross-sectional view corresponding to FIG. 4 and taken along the line A-A of FIG. 3 and showing a state where the first cover is at an intermediate position and the second cover is at the second closed position in the printer according to the embodiment.

The pair of guide protrusions 90 is disposed in the vicinity of the rear end portion of the exposure unit 6, as illustrated in FIG. 6. As illustrated in FIGS. 4 and 5, the guide protrusions 90 are separated away from each other in the up-down direction and positioned between the drum guide 69 and the first cartridge guide 73 in a side view. Each of the guide protrusions 90 connects left and right inner surfaces of the linking-unit accommodating section 71. The guide protrusions 90 have a substantially elliptical columnar shape in a side view that is elongated in the front-rear direction. Although not illustrated in the drawings, the guide protrusions 90 are arranged to have the front urging-member holding hole 89 interposed therebetween in the up-down direction.

(2) Developing Pressing Mechanism

As illustrated in FIGS. 3 and 5, the developing pressing mechanism 62 includes a pair of developing pressing members 108, a pair of pressing spring 109, and a pair of pressing releasing members 110.

Each of the pair of developing pressing members 108 is disposed within the pressing-member accommodating chamber 86 of the pressing-mechanism accommodating section 70 formed in each side wall 60. Each developing pressing member 108 has a generally rectangular columnar shape extending in the up-down direction. The developing pressing member 108 has a bottom end serving as a base end 108A. The developing pressing member 108 is configured to pivotally move about this base end 108A. The developing pressing member 108 is movable between a pressing position (see FIG. 5) pressing the developing cartridge 5 to make the developing roller 21 in contact with the photosensitive drum 17, and a non-pressing position (see FIG. 7) disabled from pressing the developing cartridge 5.

Each of the pressing springs 109 is a compression spring that extends in the front-rear direction. The pressing spring 109 is disposed between the corresponding developing pressing member 108 and a front wall defining the pressing-member accommodating chamber 86 of the pressing-mechanism accommodating section 70 formed in each side wall 60. The pressing spring 109 is configured to normally urge the corresponding developing pressing member 108 counterclockwise about the base end 108A in a left side view.

Each of the developing pressing members 108 has a distal end 108B configured to contact the corresponding second protrusion 43 of the developing cartridge 5. The distal end 108B of each developing pressing member 108 makes contact with a lower-front end of the corresponding second protrusion 43 of the developing cartridge 5 due to the urging force of the corresponding pressing spring 109, thereby normally placing the corresponding developing pressing member 108 at the pressing position pressing the developing cartridge 5.

Each of the pressing releasing members 110 is disposed in the releasing-member accommodating chamber 87 of the pressing-mechanism accommodating section 70 formed in each side wall 60. The pressing releasing member 110 is a tensile spring extending in the front-rear direction. The pressing releasing members 110 have an elastic modulus (coefficient of elasticity) higher than an elastic modulus (coefficient of elasticity) of the pressing springs 109. When the first cover 11 is located at the first closed position, the pressing releasing member 110 has a natural length. Each pressing releasing member 110 has a front end connected to a lower end portion of the first cover 11, while a rear end connected to the distal end 108B of the corresponding developing pressing member 108.

(3) Linking Unit

The linking unit 64 is disposed in the linking-unit accommodating sections 71 formed in respective side walls 60, as illustrated in FIG. 3. The linking unit 64 is movable between an engaging position (see FIG. 3) at which the linking unit 64 engages the end portion 17A of the photosensitive drum 17 and a non-engaging position (see FIG. 14) at which the linking unit 64 is disengaged from the end portion 17A of the photosensitive drum 17. Specifically, the linking unit 64 includes a pair of first arms 111 as an example of a linking member and a pair of second arms 112, as illustrated in FIGS. 3 and 5.

Each first arm 111 includes a drum holding part 114 and an arm body 113.

The drum holding part 114 constitutes a rear end portion of the first arm 111. The drum holding part 114 has a substantially columnar shape extending in the left-right direction. The drum holding part 114 is supported by the second drum guide 84. The drum holding part 114 includes a holding recess 118 and a passing part 119.

The holding recess 118 is a recess having a substantially circular shape in a side view. The holding recess 118 is recessed outward from an inner surface of the drum holding part 114 in the left-right direction. The holding recess 118 has a diameter slightly larger than a diameter of the end portion 17A of the photosensitive drum 17.

The passing part 119 is slightly recessed outward from the inner surface of the drum holding part 114 in the left-right direction and occupies an upper-front half on the inner surface of the drum holding part 114 with respect to a line connecting the upper-front and the lower-rear thereof.

The arm body 113 extends frontward from a front end of the drum holding part 114. Specifically, referring to FIG. 3, the arm body 113 extends from an outermost end on the front end of the drum holding part 114 in the left-right direction. The arm body 113 has a substantially prismatic beam-like shape. The arm body 113 is disposed between the guide protrusions 90. Accordingly, the first arm 111 is movable with the arm body 113 guided between the guide protrusions 90. The arm body 113 includes a connection boss 115.

The connection boss 115 is formed on a front end of the arm body 113. The connection boss 115 has a substantially columnar shape and protrudes outward in the left-right direction from an outer surface of the front end of the arm body 113.

As illustrated in FIG. 3, each second arm 112 is disposed frontward of the corresponding first arm 111 in the front-rear direction, and outward relative to the corresponding first arm 111 in the left-right direction. Each second arm 112 has a substantially prismatic beam-like shape extending in a direction connecting the lower-front and the upper-rear. As illustrated in FIGS. 4 and 5, each second arm 112 has a lower-front end provided with an arm shaft 112A. The second arms 112 are pivotally movably supported by left and right ends on the substantial vertical center portion of the first cover 11 at the arm shafts 112A. Each second arm 112 further includes a connection hole 120.

The connection hole 120 is formed in an upper-rear end portion of the second arm 112 to penetrate the same in the left-right direction. The connection hole 120 is a substantially elongated hole extending in a direction connecting the lower-front and the upper-rear. The connection hole 120 movably receives the connection boss 115 of the corresponding first arm 111 therein. Specifically, the connection boss 115 is positioned at a lower-front end of the connection hole 120 when the first cover 11 is at the first closed position, as shown in FIGS. 4 and 5.

(4) Urging Members

As illustrated in FIG. 3, the two urging members 65 constituting each pair of the urging members 65 are respectively accommodated in the front and rear urging-member holding holes 89 formed in each side wall 60. The urging members 65 are compression springs extending in the left-right direction. The rear urging member 65 is disposed between the inner surface defining the rear urging-member holding hole 89 in the left-right direction and the rear end portion of the corresponding first arm 111 constituting the linking unit 64. The front urging member 65 is disposed between the inner surface defining the front urging-member holding hole 89 in the left-right direction and the corresponding first arm 111 interposed between the guide protrusions 90.

With this structure, the urging members 65 are normally configured to urge the corresponding first arm 111 outward in the left-right direction.

(5) Second Cover

The second cover 15 is disposed between the side walls 60, as illustrated in FIG. 1. As described above, the second cover 15 has a substantial plate-like shape extending in the front-rear direction. The second cover 15 has a rear end provided with a second cover shaft 15A. The second cover 15 is supported by the upper-rear end portion of the main casing 2 such that the second cover 15 is pivotally movable about an axis of the second cover shaft 15A. The second cover 15 includes a cam 94 and a stopper 95.

The cam 94 is disposed on a rear portion of the second cover 15 at a position substantially center thereof in the front-rear direction and outermost end thereof in the left-right direction. The cam 94 extends downward from a lower surface of the second cover 15 and has a partial ring-like shape extending along a circumference of an imaginary circle having the second cover shaft 15A as a center thereof. As illustrated in FIG. 3, the cam 94 is disposed outward of the first arm 111 in the left-right direction within the linking-unit accommodating section 71 of the side wall 60. The cam 94 overlaps the urging member 65 accommodated in the rear urging-member holding hole 89 when projected in the left-right direction. The cam 94 includes a thick portion 97, an inclined portion 98, and a thin portion 99, as illustrated in FIGS. 3 and 5.

The thick portion 97 constitutes about ¾ of an upper portion of the cam 94. The thick portion 97 has a thickness (left-right dimension) that is the largest in the cam 94.

The inclined portion 98 extends downward from a lower end of the thick portion 97. The inclined portion 98 has an inner surface that is inclined outward in the left-right direction. More specifically, the inner surface of the inclined portion 98 is inclined such that the inclined portion 98 has a left-right dimension that decreases toward the bottom.

The thin portion 99 extends downward from a lower end of the inclined portion 98. The thin portion 99 has a thickness (a left-right dimension) smaller than the thickness (left-right dimension) of the thick portion 97.

When the second cover 15 is located at the second closed position, the thick portion 97 of the cam 94 overlaps the first arm 111 and the rear urging member 65 as viewed in the left-right direction, and contacts the first arm 111 from outside thereof in the left-right direction.

With the thick portion 97 of the cam 94 in contact with the first arm 111, the first arm 111 is displaced inward in the left-right direction within the linking-unit accommodating section 71 against the urging force of the urging member 65.

Since the first arm 111 is displaced inward in the left-right direction, the drum holding part 114 of the first arm 111 is engagement with the end portion 17A of the photosensitive drum 17.

The stopper 95 is disposed at a substantial left-right center on a front end portion of the second cover 15, as illustrated in FIG. 1. The stopper 95 protrudes downward from the lower surface of the second cover 15. The stopper 95 includes a through-hole (not shown) penetrating in the front-rear direction.

(6) Locking Mechanism

The locking mechanism 61 is disposed at an upper-front end portion of the main casing 2. Specifically, the locking mechanism 61 is provided at a position below the front end portion of the second cover 15 and above the upper end of the first cover 11. The locking mechanism 61 is movable between a locking position (see FIG. 1) locking the second cover 15 at the second closed position and an unlocking position (see FIG. 6) unlocking the second cover 15 from the second closed position. The locking mechanism 61 includes a locking member 102 and a locking spring 103.

The locking member 102 has a substantial V-shape in a side view and has a general vertical center at which a locking shaft 102A is provided. The locking shaft 102A is rotatably connected to a front wall constituting the main casing 2. The locking member 102 is thus pivotally movable about this locking shaft 102A. The locking member 102 includes a lower portion 102B and an upper portion 102C, as illustrated in FIG. 1.

The lower portion 102B extends rearward and downward from the locking shaft 102A.

The upper portion 102C extends upward from the locking shaft 102A. The upper portion 102C has an upper end protruding forward to form a hook shape. The upper end of the upper portion 102C is engageable with the through-hole formed in the stopper 95.

The locking spring 103 is a compression spring extending in the front-rear direction. The locking spring 103 is disposed between the upper portion 102C and the front wall of the main casing 2. Accordingly, the locking spring 103 is configured to normally urge the locking member 102 (upper portion 102C) counterclockwise in a left side view about the locking shaft 102A.

The upper end of the first cover 11 makes contact with a lower end of the lower portion 102B constituting the locking member 102 when the first cover 11 is in its first closed position. Thus, due to the contact of the first cover 11 against the lower end of the lower portion 102B, the locking mechanism 61 is placed at the locking position where the upper portion 102C engages the stopper 95 against the urging force of the locking spring 103.

5. Attachment/Detachment of the Developing Cartridge and Drum Cartridge

Hereinafter, attachment/detachment of the developing cartridge 5 and the drum cartridge 4 will be described.

(1) Attachment/Detachment of the Developing Cartridge

Figure 7:
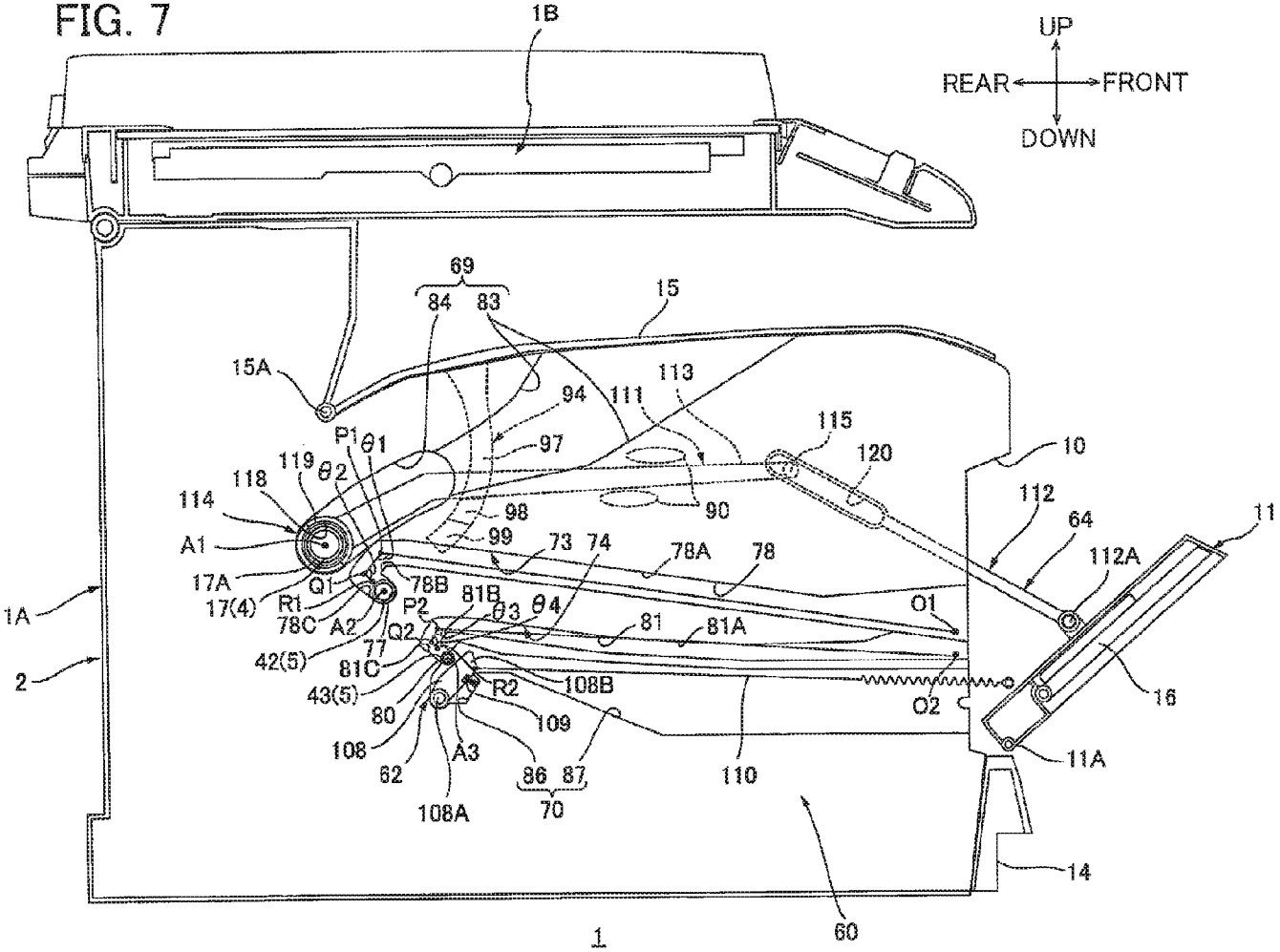
FIG. 7 is a cross-sectional view corresponding to FIG. 5 and taken along the line B-B of FIG. 3 and showing a state where the first cover is at the intermediate position and the second cover is at the second closed position in the printer according to the embodiment.

For removing the developing cartridge 5 attached to the main casing 2, the first cover 11 is pivoted from the first closed position to the intermediate position shown in FIGS. 6 and 7.

The first cover 11 is pivoted about the axis of the first cover shaft 11A clockwise in a left side view from the first closed position, thereby placing the first cover 11 to the intermediate position. The first cover 11 is angularly rotated by an angle of about 45 degrees to move from the first closed position to the intermediate position.

Figure 8:
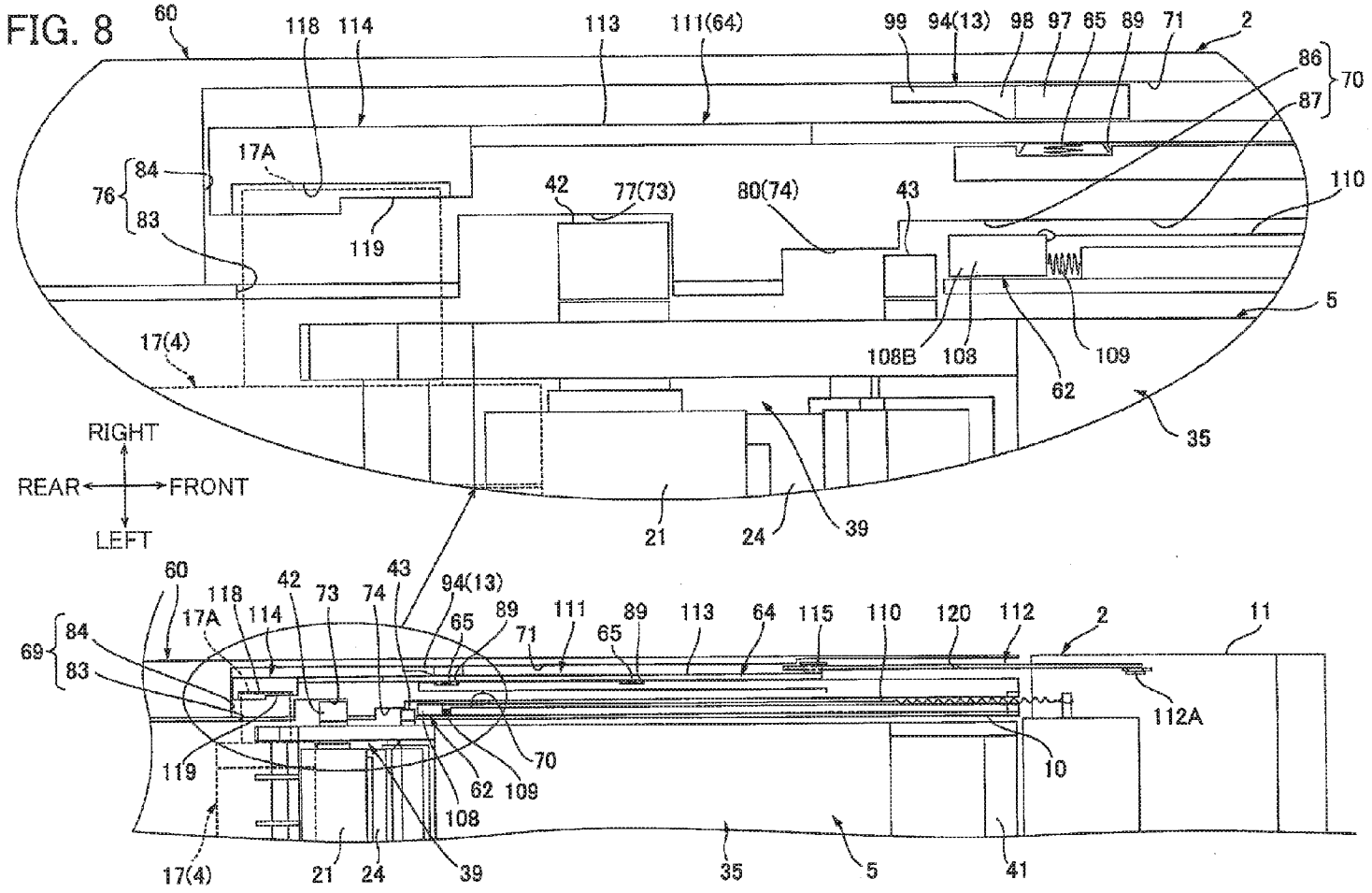
FIG. 8 is a view for description of a state of the drum cartridge and the developing cartridge in the printer shown in FIGS. 6 and 7.

As illustrated in FIGS. 7 and 8, the front end of the pressing releasing member 110 is pulled frontward as the first cover 11 is pivoted, which in turn causes the distal ends 108B of the developing pressing members 108 to be pulled forward.

At this time, since the elastic modulus of the pressing releasing member 110 is higher than the elastic modulus of the pressing spring 109, the pressing releasing members 110 make the respective developing pressing members 108 pivot clockwise about the respective axes of the base ends 108A in a left side view against the urging force of the pressing springs 109.

In this way, the developing pressing members 108 are pulled frontward by the pressing releasing members 110 in conjunction with the pivotal movement of the first cover 11, bringing the distal ends 108B in contact with the front walls defining the respective pressing-member accommodating chambers 86. The developing pressing members 108 are thus moved from the pressing position to the non-pressing position.

The distal ends 108B of the developing pressing members 108 are thus separated forward and downward from the second protrusions 43 of the developing cartridge 5 to be spaced away therefrom.

Since the distal ends 108B of the developing pressing members 108 are separated from the respective second protrusions 43, the developing cartridge 5 is no longer applied with pressing force from the developing pressing members 108. As a result, the developing cartridge 5 moves forward and downward by its own weight with the first protrusions 42 guided by the second developing guides 77 and with the second protrusions 43 guided by the second developing guides 80. The developing roller 21 is accordingly moved to the separated position separated from the photosensitive drum 17.

Also, in the linking unit 64, the lower-front end of the second arm 112 is pulled forward and downward in conjunction with the pivotal movement of the first cover 11 from the first closed position to the intermediate position. At this time, the first arm 111 does not move but only the second arm 112 moves forward and downward. Accordingly, the connection boss 115 of the first arm 111 is received in the connection hole 120 formed in the second arm 112 at an upper-rear portion thereof.

Figure 9:
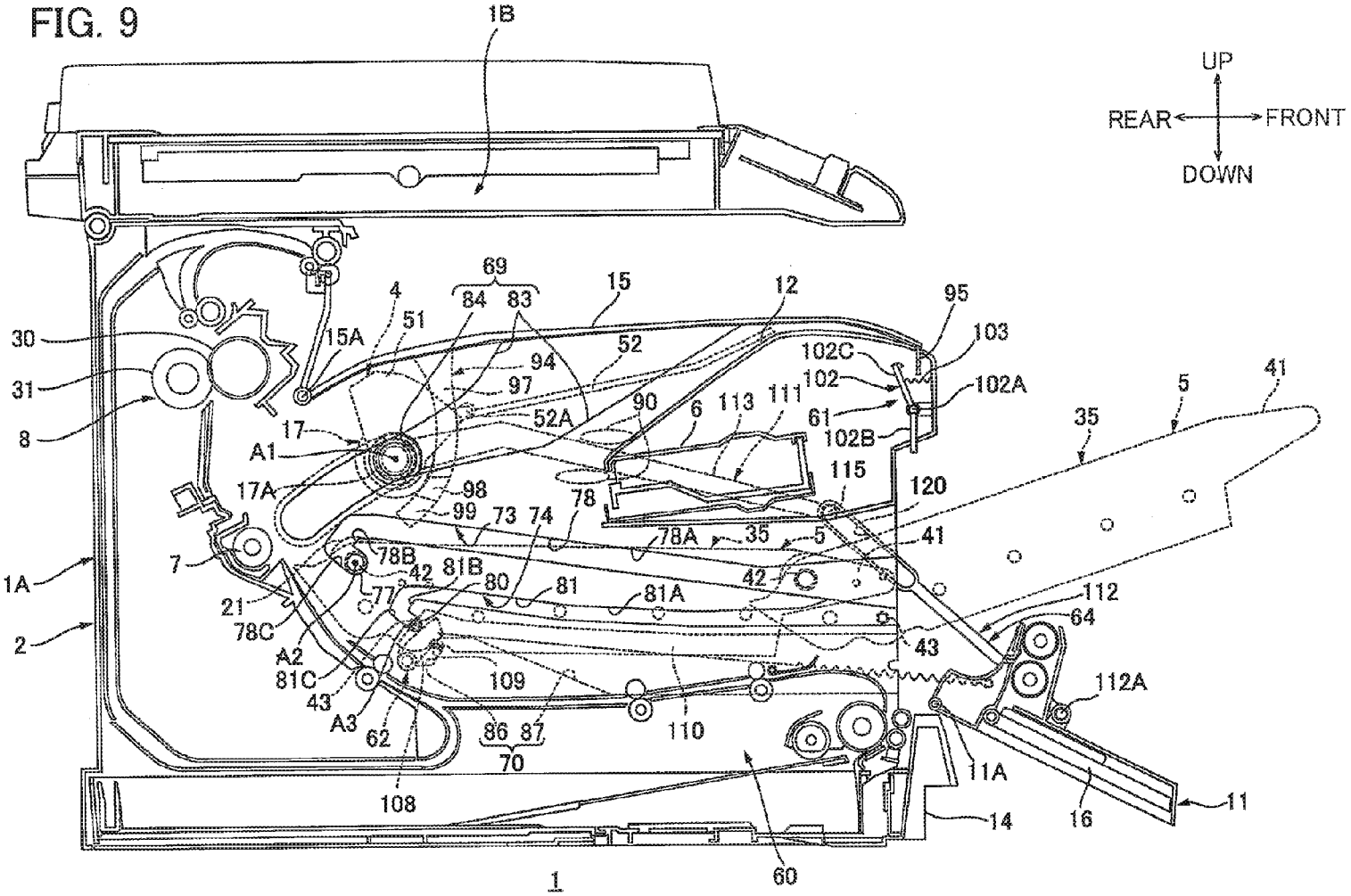
FIG. 9 is a cross-sectional view corresponding to FIG. 4 and taken along the line A-A of FIG. 3 and showing a state where the first cover is at a first open position and the second cover is at the second closed position in the printer according to the embodiment.
Figure 10:
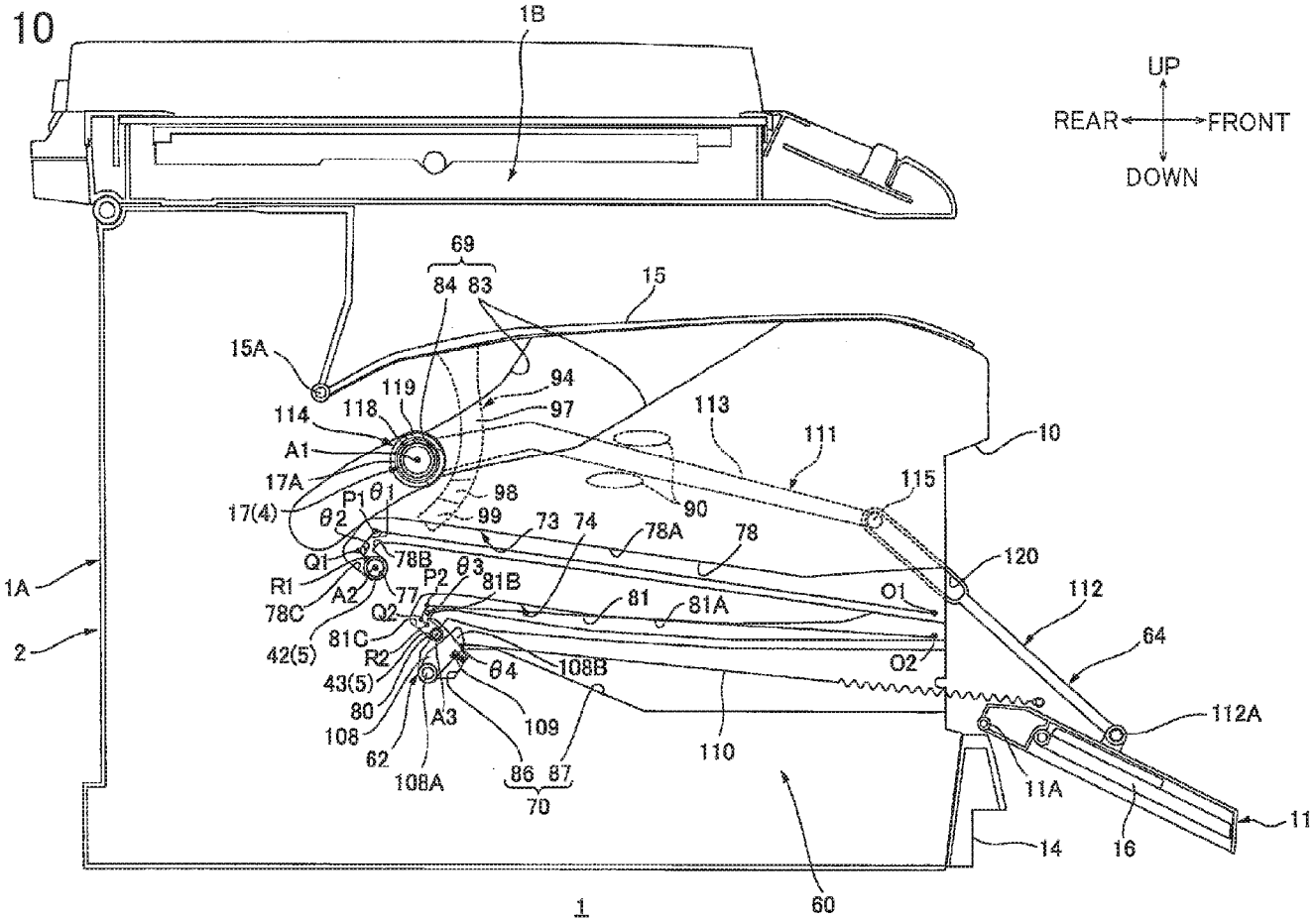
FIG. 10 is a cross-sectional view corresponding to FIG. 5 and taken along the line B-B of FIG. 3 and showing a state where the first cover is at the first open position and the second cover is at the second closed position in the printer according to the embodiment.

Next, the first cover 11 is further moved from the intermediate position to the first open position, as illustrated in FIGS. 9 and 10.

The first cover 11 is pivoted about the axis of the first cover shaft 11A clockwise in a left side view from the intermediate position, bringing the first cover 11 into the first open position. The first cover 11 is angularly rotated by an angle of about 90 degrees to move from the first closed position to the first open position.

Figure 11:
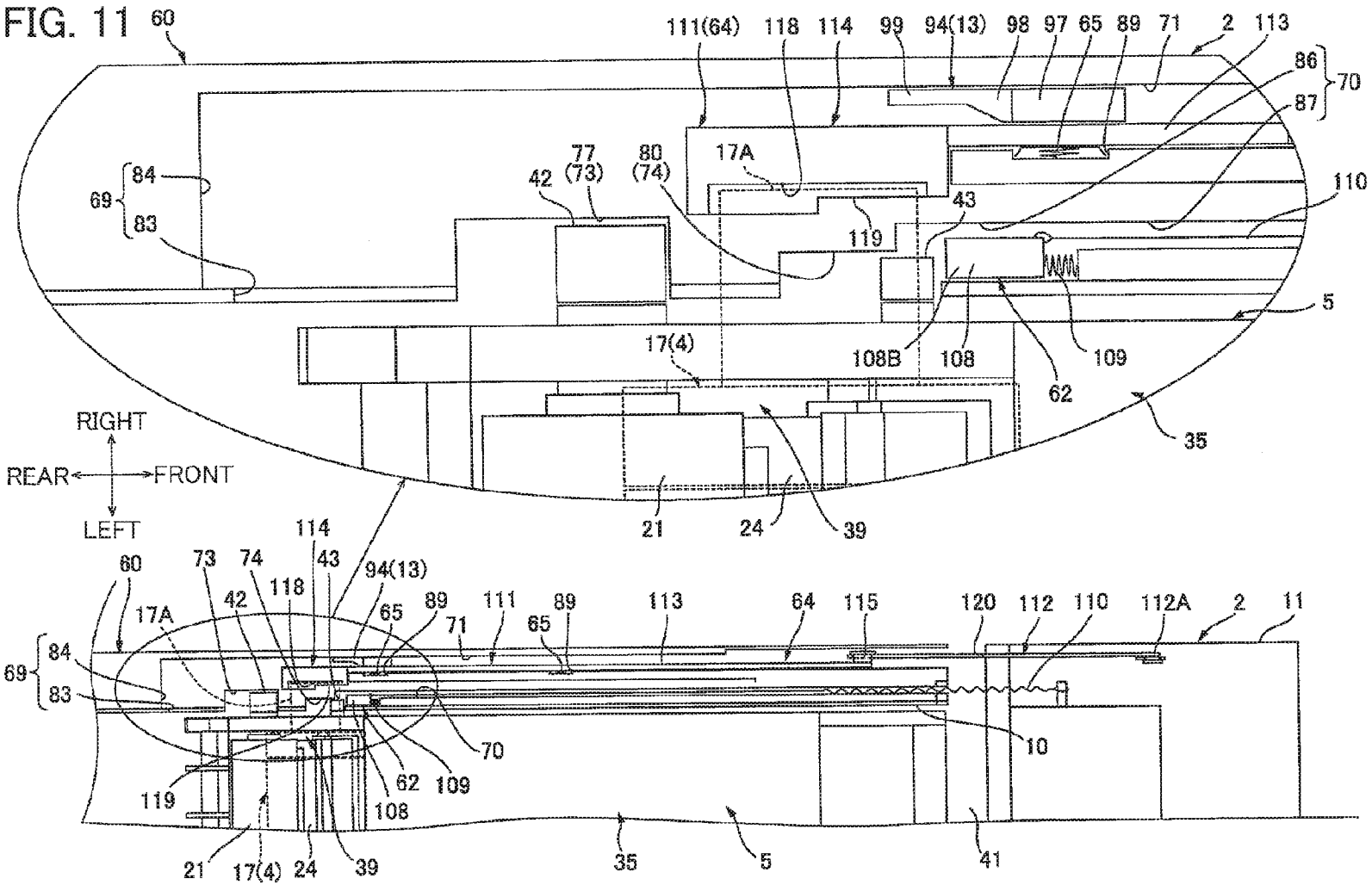
FIG. 11 is a view for description of a state of the drum cartridge and the developing cartridge in the printer shown in FIGS. 9 and 10.

At this time, the pressing releasing members 110 are caused to expand frontward against the urging force thereof, since the distal ends 108B of the developing pressing members 108 are respectively in contact with the front walls of the pressing-member accommodating chambers 86, as illustrated in FIGS. 10 and 11.

Further, the lower-front ends of the respective second arms 112 are pulled forward and downward in conjunction with the pivotal movement of the first cover 11, moving the second arms 112 further forward and downward.

As the second arms 112 move forward and downward, the connection bosses 115 of the first arms 111 are brought into contact with the upper-rear end portions of the connection holes 120 formed in the second arms 112, respectively, thereby pulling the first arms 111 forward.

As the first arms 111 are pulled forward, the first arms 111 are configured to pass between the corresponding pair of guide protrusions 90. That is, the first arms 111 move forward while making pivotal movement in a clockwise direction in a left side view about the corresponding guide protrusions 90.

In accordance with the frontward movement of the first arms 111, the drum holding parts 114 of the first arms 111 move the photosensitive drum 17 in a direction from the lower-rear toward the upper-front along the second drum guide 84. The drum cartridge 4 is moved to the non-image-forming position.

In this way, the photosensitive drum 17 is retracted from a trajectory of the developing roller 21 that moves along the first cartridge guides 73.

Note that, even when each first arm 111 moves, the urging members 65 are in contact with the inner surface of the corresponding first arm 111 in the left-right direction. Thus, the first arms 111 are still displaced inward in the left-right direction.

Then, the developing cartridge 5 is removed.

Specifically, the user grips the developing grip part 41 to move the developing cartridge 5 rearward and upward, while the first protrusions 42 are being guided by the second developing guides 77 of the first cartridge guides 73 and the third portions 78C of the first developing guides 78, and while the second protrusions 43 are being guided by the second developing guides 80 of the second cartridge guides 74 and the third portions 81C of the first developing guides 81.

At this time, the rear end portion of the developing cartridge 5 is placed in a space in which the drum cartridge 4 at the image-forming position was disposed.

The developing cartridge 5 is then moved forward and upward, with the first protrusions 42 being guided by the second portions 78B of the first developing guides 78 of the first cartridge guides 73, and with the second protrusions 43 being guided by the second portions 81B of the first developing guides 81 constituting the second cartridge guides 74.

The developing cartridge 5 is subsequently moved forward and downward, with the first protrusions 42 being guided by the first portions 78A of the first developing guides 78 of the first cartridge guides 73, and with the second protrusions 43 being guided by the first portions 81A of the first developing guides 81 of the second cartridge guides 74. The developing cartridge 5 is then further moved forward and downward while passing below the exposure unit 6, and is finally removed from the main casing 2 through the first opening 10. The developing cartridge 5 is thus situated at the detachable position.

The detachment of the developing cartridge 5 from the main casing 2 is thus completed.

For attaching the developing cartridge 5 to the main casing 2, the above-described procedures will be performed in reverse with respect to the main casing 2 and the developing cartridge 5.

Specifically, the user gripping the developing grip part 41 first inserts the developing cartridge 5 into the main casing 2 through the first opening 10. At this time, the developing cartridge 5 is inserted such that the first protrusions 42 are fitted to the first portions 78A of the first developing guides 78 of the first cartridge guides 73 and the second protrusions 43 are fitted to the first portions 81A of the first developing guides 81 of the second cartridge guides 74.

Next, the developing cartridge 5 is pushed rearward and upward into the main casing 2.

While the developing cartridge 5 is moved rearward and upward, the first protrusions 42 are guided by the first portions 78A of the first developing guides 78 of the first cartridge guides 73 and the second protrusions 43 are guided by the first portions 81A of the first developing guides 81 of the second cartridge guides 74.

The developing cartridge 5 is then pushed rearward deeper.

While the developing cartridge 5 is further moved rearward and downward, the first protrusions 42 are guided by the second portions 78B of the first developing guides 78 of the first cartridge guides 73 and the second protrusions 43 are guided by the second portions 81B of the first developing guides 81 of the second cartridge guides 74.

When the first protrusions 42 arrive at the rear ends of the first developing guides 78 and the second protrusions 43 arrive at the rear ends of the second developing guides 80, the developing cartridge 5 is prevented from moving further rearward.

Next, as illustrated in FIGS. 6 and 7, the developing cartridge 5 is moved forward and downward by its own weight, with the first protrusions 42 being guided by the third portions 78C of the first developing guides 78 of the first cartridge guides 73 and the second developing guides 77, and with the second protrusions 43 being guided by the third portions 81C of the first developing guides 81 of the second cartridge guides 74 and the second developing guides 80.

In this way, the first protrusions 42 are held by the lower ends of the second developing guides 77, and the second protrusions 43 are held by the lower ends of the second developing guides 80. The developing cartridge 5 is thus no longer moved further frontward and downward and is fixed in position relative to the main casing 2.

Next, the first cover 11 is moved from the first open position toward the first closed position. In the course of the pivotal movement of the first cover 11 from the first open position toward the first closed position, the tension applied to the pressing releasing members 110 is released, bringing the pressing releasing members 110 back to their natural length.

The first cover 11 is further pivoted toward the first closed position, as illustrated in FIGS. 4 and 5.

The pressing releasing members 110 are no longer pulled by the respective developing pressing members 108 connected to the first cover 11. As a result, the developing pressing members 108 are pivotally moved counterclockwise in a left side view about the base ends 108A by the urging force of the corresponding pressing springs 109.

In this way, the developing pressing members 108 are brought into contact with the respective second protrusions 43 and press the second protrusions 43 rearward and upward. The developing cartridge 5 is thereby pressed rearward and upward and the developing roller 21 is brought into contact with the photosensitive drum 17. That is, the developing pressing members 108 are located at the pressing position.

In the meantime, the second arms 112 of the linking unit 64 is also moved rearward and upward by the front lower end thereof being pushed rearward and upward in conjunction with the pivotal movement of the first cover 11 toward the first closed position.

Accordingly, the drum holding parts 114 supporting the end portions 17A of the photosensitive drum 17 are moved backward and downward along the second drum guides 84, thereby moving the drum cartridge 4 rearward and downward. When the drum holding parts 114 arrive at the lower rear ends of the respective second drum guides 84, the drum cartridge 4 is no longer moved rearward and downward and is fixed in position relative to the main casing 2.

The attachment of the developing cartridge 5 to the main casing 2 is thus completed.

(2) Attachment/Detachment of the Drum Cartridge

For removing the drum cartridge 4 attached to the main casing 2, as illustrated in FIGS. 9 and 10, the first cover 11 is moved to the first open position to bring the drum cartridge 4 into the non-image-forming position, as described above.

At this time, as illustrated in FIG. 9, the contact of the first cover 11 against the lower portion 102B of the locking member 102 is released. Thus the locking spring 103 urges the upper portion 102C of the locking member 102 rearward.

The locking member 102 is therefore pivoted about the locking shaft 102A in the counterclockwise direction in a left side view by the urging force of the locking spring 103. The upper portion 102C of the locking member 102 is disengaged from the stopper 95, placing the locking mechanism 61 to the unlocking position.

Figure 12:
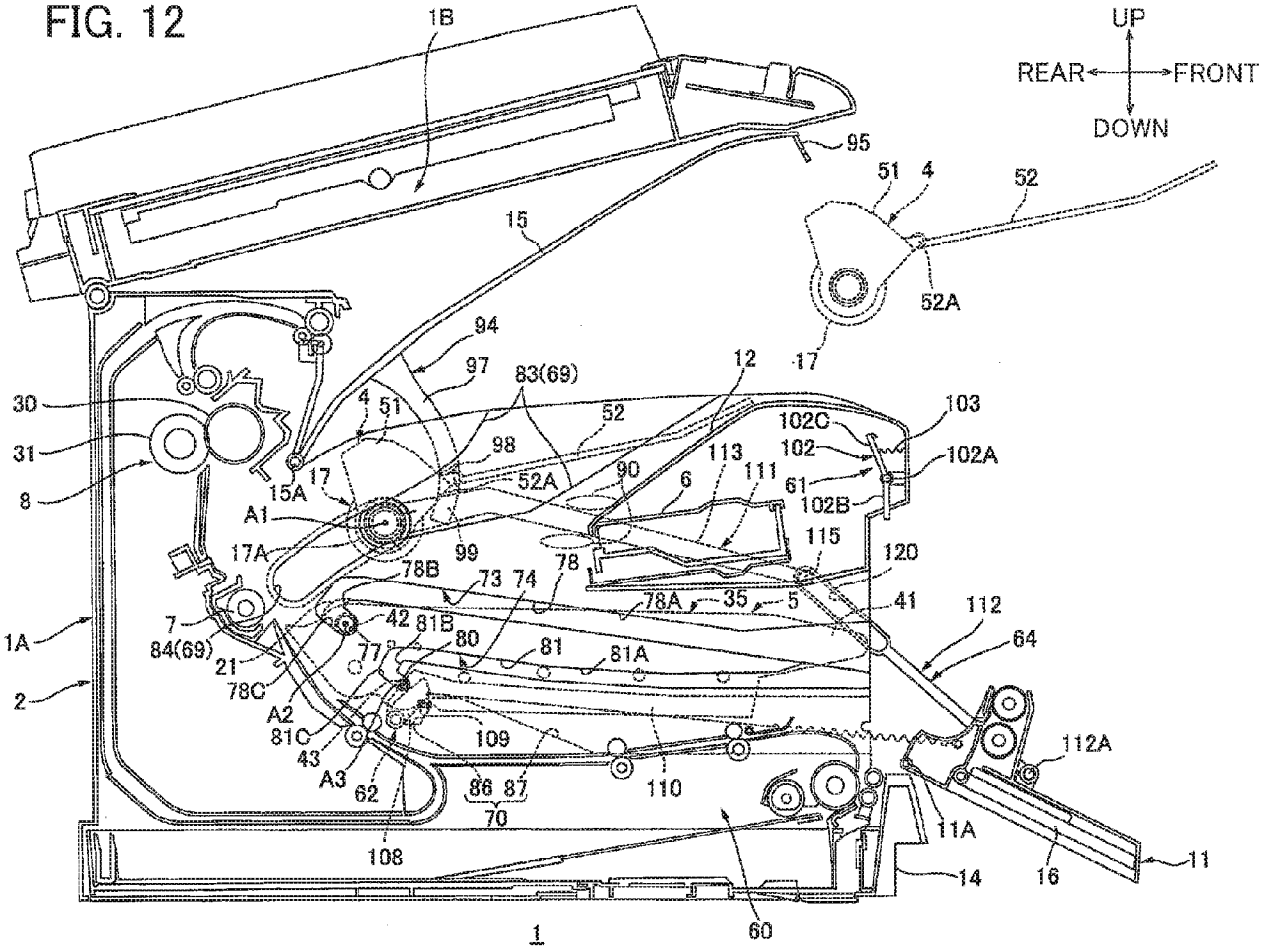
FIG. 12 is a cross-sectional view corresponding to FIG. 4 and taken along the line A-A of FIG. 3 and showing a state where the first cover is at the first open position and the second cover is at a second open position in the printer according to the embodiment.
Figure 13:
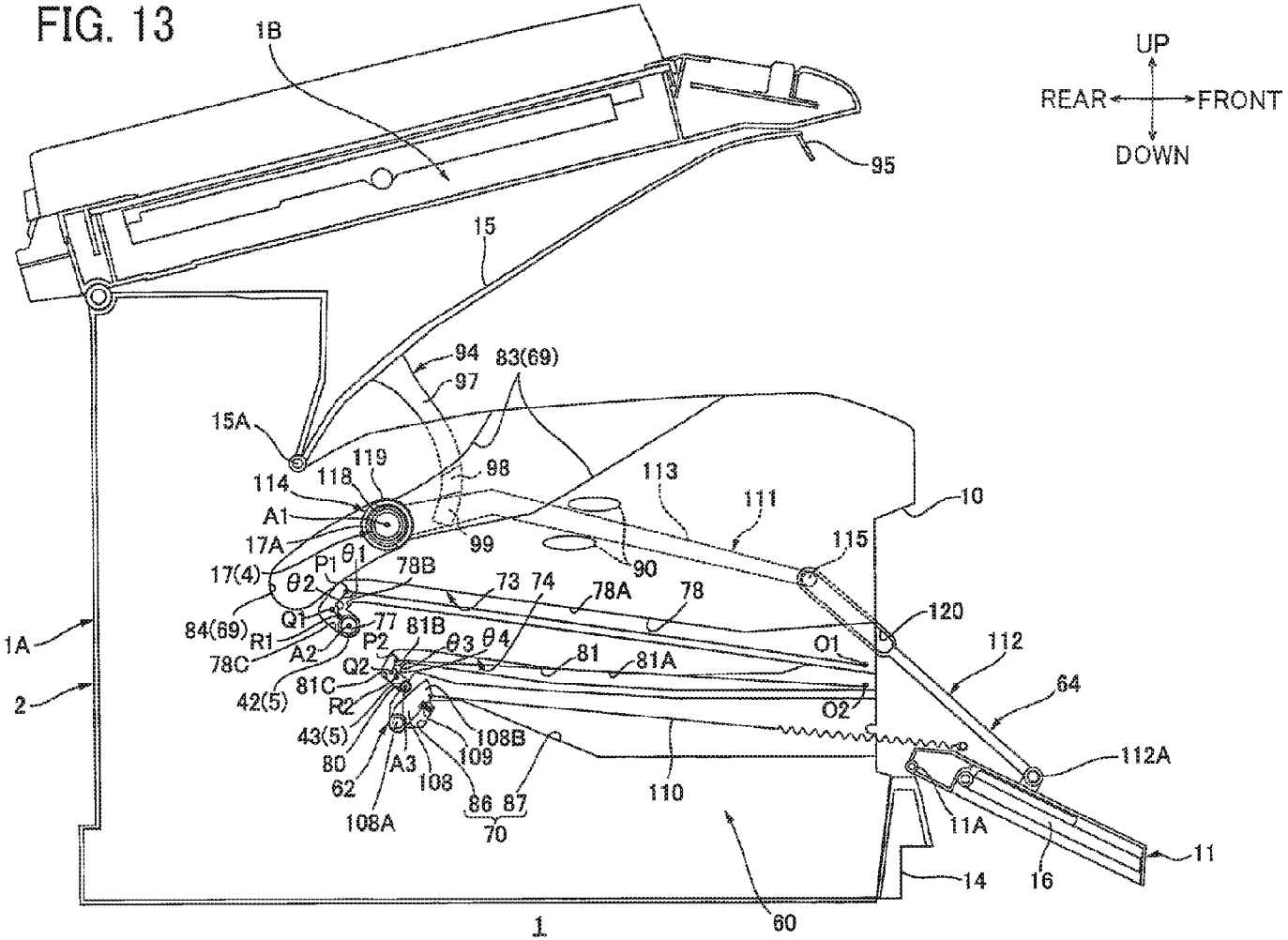
FIG. 13 is a cross-sectional view corresponding to FIG. 5 and taken along the line B-B of FIG. 3 and showing a state where the first cover is at the first open position and the second cover is at the second open position in the printer according to the embodiment.

Next, the second cover 15 is moved upward to the second open position from the second closed position, as illustrated in FIGS. 12 and 13.

Specifically, the second cover 15 is pivoted counterclockwise in a left side view about the axis of the second cover shaft 15A. In accordance with the pivotal movement of the second cover 15, the cams 94 are also moved upward. As each cam 94 moves upward, the first arm 111 of the linking unit 64 sequentially overlap with the thick portion 97, the inclined portion 98 and the thin portion 99 when projected in the left-right direction.

Figure 14:
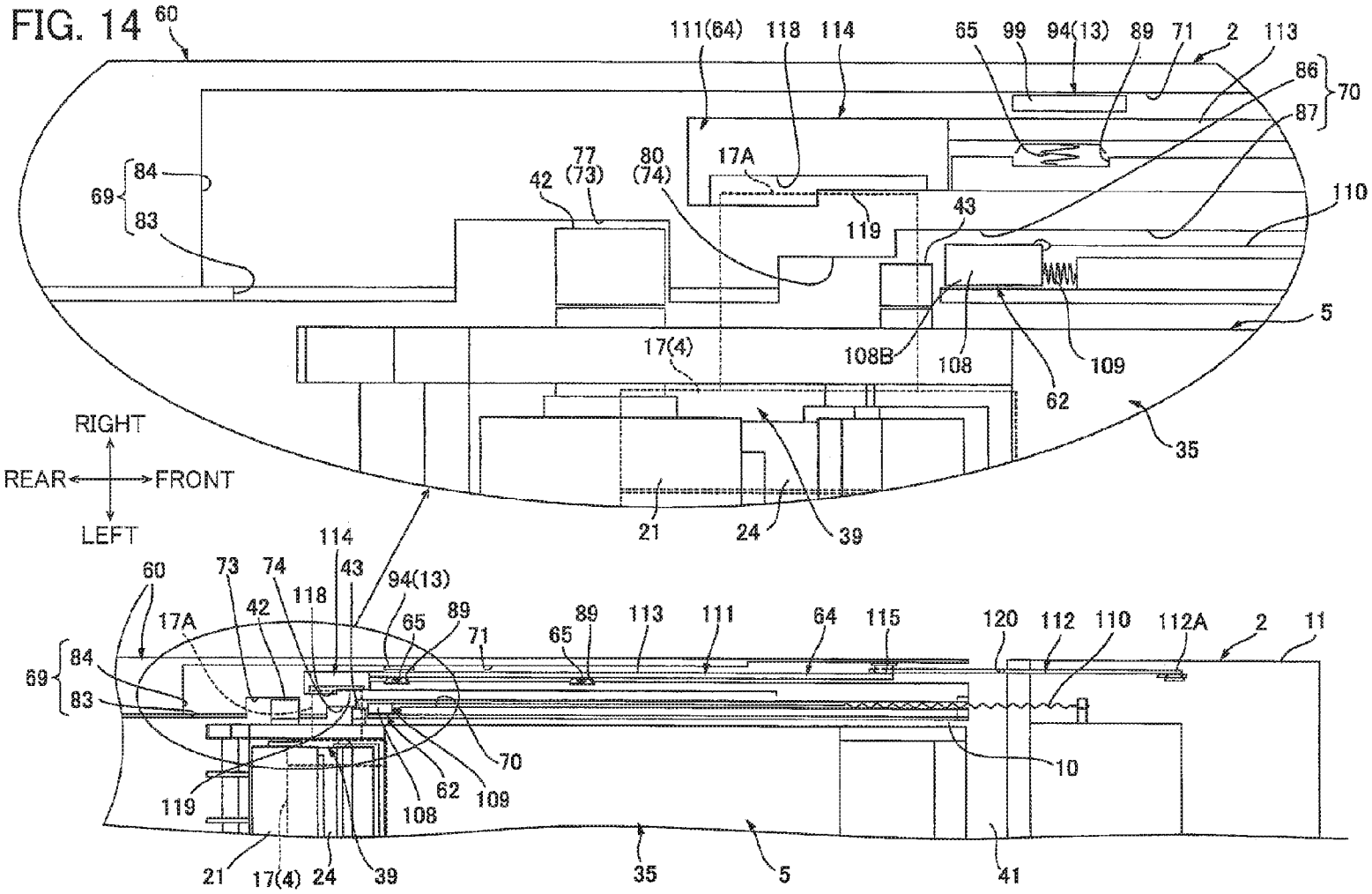
FIG. 14 is a view for description of a state of the drum cartridge and the developing cartridge in the printer shown in FIGS. 12 and 13.

When the first arms 111 overlap the thin portion 99 of the cams 94, the first arms 111 are respectively moved outward in the left-right direction by the urging force of the urging members 65, as illustrated in FIG. 14. The linking unit 64 is thus located at the non-engaging position, thereby releasing the engagement between the holding recesses 118 of the first arms 111 and the end portions 17A of the photosensitive drum 17.

As a result, the end portions 17A of the photosensitive drum 17 face the passing parts 119 in the left-right direction.

Subsequently, the drum cartridge 4 is pulled forward and upward.

Specifically, the drum cartridge 4 is moved forward and upward while the end portions 17A of the photosensitive drum 17 pass by the passing parts 119 and are guided along the first drum guides 83.

The drum cartridge 4 is further moved forward and upward with the end portions 17A of the photosensitive drum 17 being guided by the first drum guides 83, passes above the exposure unit 6, and is finally removed from the main casing 2 through the second opening 12.

The detachment of the drum cartridge 4 from the main casing 2 is thus completed.

For attaching the drum cartridge 4 to the main casing 2, the above-described procedures will be performed in reverse with respect to the main casing 2 and the drum cartridge 4.

Specifically, the drum cartridge 4 is first inserted into the main casing 2 through the second opening 12 with the end portions 17A of the photosensitive drum 17 fitted to the respective first drum guides 83.

The drum cartridge 4 is then moved downward.

The drum cartridge 4 is moved rearward and downward while the end portions 17A of the photosensitive drum 17 are guided by the first drum guides 83.

When projected in the left-right direction, as illustrated in FIG. 14, the end portions 17A of the photosensitive drum 17 pass the passing parts 119 and overlap (oppose) the holding recesses 118 of the drum holding parts 114.

Next, the second cover 15 is moved from the second open position toward the second closed position, as illustrated in FIGS. 9 and 10.

In accordance with the pivotal movement of the second cover 15 toward the second closed position, the first arms 111 sequentially overlap with the thin portions 99, the inclined portions 98 and thick portions 97 of the cams 94 when projected in the left-right direction.

When the first arms 111 oppose the respective thick portions 97 in the left-right direction, the first arms 111 are moved inward in the left-right direction by the thick portions 97 against the urging force of the urging members 65, as illustrated in FIG. 11. Accordingly, the linking unit 64 is placed at the engaging position, and the holding recesses 118 of the first arms 111 respectively engage the end portions 17A of the photosensitive drum 17.

Then, the first cover 11 is moved to the first closed position from the first open position. In conjunction with the pivotal movement of the first cover 11 toward the first closed position, the drum cartridge 4 is moved to the image-forming position in accordance with the rearward movement of the first arms 111, as illustrated in FIGS. 4 and 5.

In the locking mechanism 61, the first cover 11 at the first closed position contacts the lower portion 102B of the locking member 102 to pivotally move the locking member 102 clockwise in a left side view against the urging force of the locking spring 103, as shown in FIG. 1. Accordingly, the upper portion 102C of the locking member 102 engages the stopper 95, placing the locking mechanism 61 at the locking position.

The attachment of the drum cartridge 4 to the main casing 2 is thus completed.

6. Operational and Technical Advantages (1) According to the printer 1 of the embodiment, the movement of the developing cartridge 5 between the detachable position and the contact position is guided by the first developing guides 78 and the first developing guides 81, as illustrated in FIGS. 4 and 9. Further, the movement of the developing cartridge 5 between the contact position and the separated position lower than the contact position is guided by the second developing guides 77 and the second developing guides 80, as illustrated in FIGS. 4 and 6.

Further, the developing cartridge 5 is pressed by the developing pressing members 108 in a direction in which the developing roller 21 approaches toward the photosensitive drum 17, that is, diagonally rearward and upward. That is, the developing pressing members 108 are arranged frontward and downward of the second developing guides 77 and the second developing guides 80 both of which serve to guide the movement of the developing cartridge 5 between the contact position and the separated position. In other words, the developing pressing members 108 are disposed frontward and downward of the developing cartridge 5.

With this structure, the developing cartridge 5 can be attached to the main casing 2 without interfering with the developing pressing members 108. Further, the developing pressing members 108 positioned forward and downward of the developing cartridge 5 can prevent the developing cartridge 5 from dropping down from the main casing 2.

(2) In the printer 1 of the embodiment, the second developing guides 77 extend in a direction (diagonally rearward and upward) parallel to the direction connecting between the center axis A1 of the photosensitive drum 17 and the center axis A2 of the developing roller 21 of the developing cartridge 5 attached to the printer 1, as illustrated in FIGS. 4 and 5. Hence, the developing roller 21 can be reliably made in contact with the photosensitive drum 17 with the second protrusions 43 of the developing cartridge 5 pressed by the developing pressing members 108 and with the first protrusions 42 guided by the second developing guides 77.

(3) According to the printer 1 of the embodiment, as illustrated in FIG. 9, the developing cartridge 5 is first guided rearward and upward by the first portions 78A, is then guided rearward and downward by the second portions 78B, and is finally guided to reach the second developing guides 77 by the third portions 78C.

With this structure, the developing cartridge 5 can be smoothly attached to the main casing 2 while changing directions to be attached thereto.

(4) As illustrated in FIG. 4, the second portions 78B are positioned closer to the photosensitive drum 17 than the first portions 78A and the third portions 78C are to the photosensitive drum 17. By making the developing pressing members 108 press the developing cartridge 5 guided by the second developing guides 77 toward the second portions 78B, the developing roller 21 and the photosensitive drum 17 can be reliably made in contact with each other.

(5) As illustrated in FIGS. 4 and 5, within the main casing 2, the developing cartridge 5 can change its moving direction (make a turn) by an angle ranging from 70 to 110 degrees while being guided by the first portions 78A and the second portions 78B of the first developing guides 78.

(6) As illustrated in FIGS. 4 and 5, within the main casing 2, the developing cartridge 5 can change its moving direction by an angle ranging from 70 to 110 degrees while being guided by the second portions 78B and the third portions 78C of the first developing guides 78.

(7) As illustrated in FIG. 9, the second developing guides 77 and first developing guides 78, which are positioned below the exposure unit 6, can guide the developing cartridge 5 to pass below the exposure unit 6 and to be inserted into and attached to the main casing 2.

That is, the developing cartridge 5 can be attached to the main casing 2 using the space below the exposure unit 6. This structure can ensure a larger space for storing toner in the developing cartridge 5. Further, this structure enables the developing roller 21 to be made in contact with the photosensitive drum 17 from its lower-front side, thereby suppressing the toner carried on the developing roller 21 from dropping off the developing roller 21, falling onto the surface of the photosensitive drum 17 and getting adhered thereto.

(8) As illustrated in FIGS. 4 and 9, the developing cartridge 5 can be attached to and detached from the main casing 2 through the first opening 10 by opening and closing the first cover 11.

(9) As illustrated in FIGS. 5 and 7, in conjunction with the movement of the first cover 11 from the first closed position to the first open position, the pressing releasing members 110 can pull the distal ends 108B of the developing pressing members 108 forward to move the developing pressing members 108 from the pressing position to the non-pressing position against the urging force of the pressing springs 109.

In this way, a simple operation for opening the first cover 11 can move the developing pressing members 108 to the non-pressing position from the pressing position.

(10) As illustrated in FIGS. 6 and 9, the drum cartridge 4 supporting the photosensitive drum 17 can move between the image-forming position and the non-image-forming position by being guided by the drum guides 69, in conjunction with movement of the first cover 11 between the first open position and the first closed position.

That is, the developing cartridge 5 can be removed from the main casing 2 after the photosensitive drum 17 is separated from the developing roller 21. Hence, sliding contact of photosensitive drum 17 against the developing roller 21 can be suppressed, thereby preventing degradation of the developing roller 21.

(11) As illustrated in FIGS. 9 and 10, the linking unit 64 can move the photosensitive drum 17 (drum cartridge 4) from the image-forming position to the non-image-forming position by holding the end portions 17A of the photosensitive drum 17 in the drum holding parts 114 of the respective first arms 111 in conjunction with the movement of the first cover 11 from the first closed position to the first open position.

In this way, a simple operation for opening the first cover 11 can move the drum cartridge 4 from the image-forming position to the non-image-forming position.

(12) As illustrated in FIG. 11, the linking unit 64 can move the photosensitive drum 17 (drum cartridge 4) between the image-forming position and the non-image-forming position by receiving the end portions 17A of the photosensitive drum 17 in the drum holding parts 114 of the respective first arms 111, that is, when the linking unit 64 is at the engaging position.

Further, as illustrated in FIG. 14, the drum cartridge 4 supporting the photosensitive drum 17 can be attached to and detached from the main casing 2 through the second opening 12 by separating the drum holding parts 114 of the respective first arms 111 from the end portions 17A of the photosensitive drum 17, i.e., when the linking unit 64 is at the non-engaging position.

(13) As illustrated in FIGS. 5 and 7, the first cover 11 is moved from the first closed position to the intermediate position, causing the pressing releasing members 110 to move the developing pressing members 108 from the pressing position to the non-pressing position. Then, as illustrated in FIGS. 7 and 10, when the first cover 11 is further moved from the intermediate position to the first open position, the linking unit 64 is caused to move the photosensitive drum 17 from the image-forming position to the non-image-forming position.

That is, one single operation to move the first cover 11 from the first closed position to the first open position can sequentially act on the pressing releasing members 110 and then on the linking unit 64, thereby reliably moving both of the developing pressing members 108 and the photosensitive drum 17 without interfering with each other.

Both of the developing pressing members 108 and the photosensitive drum 17 can be moved through a simple operation for moving the first cover 11.

(14) As illustrated in FIG. 12, the drum cartridge 4 can be attached to and detached from the main casing 2 through the second opening 12 that is different from the first opening 10.

That is, the photosensitive drum 17 can be reliably disposed above the developing roller 21. Hence, this structure can reliably suppress the toner carried on the developing roller 21 from falling onto and adhering to the photosensitive drum 17.

Further, the developing cartridge 5 and the drum cartridge 4 can be replaced independently of each other.

(15) As illustrated in FIG. 12, the drum cartridge 4 can be attached to and detached from the main casing 2 above the exposure unit 6.

(16) As illustrated in FIGS. 11 and 14, the linking unit 64 (drum holding part 114 of the first arm 111) can be moved from the engaging position to the non-engaging position simply by the urging force of the urging members 65.

(17) As illustrated in FIGS. 13 and 14, the second cover 15 is moved from the second closed position to the second open position, moving the cams 94, which in turn causes the first arms 111 to move by the urging force of the urging members 65, thereby moving the linking unit 64 from the engaging position to the non-engaging position.

Hence, simply moving the second cover 15 from the second closed position to the second open position can cause the photosensitive drum 17 engaged with the linking unit 64 (drum holding parts 114) to be disengaged from the linking unit 64 (drum holding parts 114), by which the photosensitive drum 17 can be made detachable from the main casing 2.

(18) As illustrated in FIG. 1, the second cover 15 is normally locked at the second closed position by the locking mechanism 61, as long as the first cover 11 is at the first closed position.

That is, the drum cartridge 4 cannot be replaced unless the developing roller 21 is separated from the photosensitive drum 17, i.e., unless the developing cartridge 5 is at the separated position.

7. Other Embodiments

The depicted printer 1 is merely an example of the image-forming apparatus according to the embodiment. Various modifications are available.

For example, instead of the exposure unit 6 using a laser beam, an LED unit using LEDs can be employed in place of the exposure unit 6. With this structure, similar operational and technical advantages as the above-described embodiment can be obtained.

While the description has been made in detail with reference to specific embodiments thereof, it would be apparent to those skilled in the art that various changes and modifications may be made therein without departing from the scope of the above described embodiments.

What is claimed is:

1. An image-forming apparatus comprising:

a photosensitive drum;

a developing cartridge including a developing roller, the developing cartridge being movable between a detachable position at which the developing cartridge is detachable from the image-forming apparatus and a contact position at which the developing roller is in contact with the photosensitive drum, the developing cartridge being further movable between the contact position and a separated position at which the developing roller is separated from the photosensitive drum, the developing cartridge being positioned higher when at the contact position than at the separated position;

a first developing guide configured to guide movement of the developing cartridge between the detachable position and the contact position, the first developing guide comprising:

a first portion sloping upward from a first end to a second end, the first portion extending in a first direction;

a second portion sloping downward from the second end to a third end, the second portion extending in a second direction; and a third portion sloping downward from the third end to a fourth end, the third portion extending in a third direction different from the second direction;

a developing pressing member configured to press the developing cartridge in such a direction that the developing roller is pressed toward the photosensitive drum, the developing pressing member pressing the developing cartridge to place the developing cartridge at the contact position, the developing pressing member being disabled from pressing the developing cartridge to place the developing cartridge at the separated position; and a second developing guide configured to guide movement of the developing cartridge between the contact position and the separated position, wherein the second developing guide extends in the third direction and is connected to the fourth end of the third portion.

2. The image-forming apparatus as claimed in claim 1, wherein the photosensitive drum defines an axis and the developing roller defines an axis, the second developing guide extending in parallel to a direction connecting between the axis of the photosensitive drum and the axis of the developing roller.

3. The image-forming apparatus as claimed in claim 1, wherein the second portion is positioned closer to the photosensitive drum than each of the first portion and the third portion is to the photosensitive drum.

4. The image-forming apparatus as claimed in claim 1, wherein the first direction and the second direction form an angle ranging from 70 to 110 degrees therebetween.

5. The image-forming apparatus as claimed in claim 1, wherein the second direction and the third direction form an angle ranging from 70 to 110 degrees therebetween.

6. The image-forming apparatus as claimed in claim 1, further comprising an exposure unit configured to expose a surface of the photosensitive drum, wherein the first developing guide and the second developing guide are disposed below the exposure unit.

7. The image-forming apparatus as claimed in claim 1, further comprising:

a main casing formed with an opening, the developing cartridge being inserted in and removed from the main casing through the opening; and a cover movably provided at the main casing, the cover being movable between a closed position closing the opening and an open position opening the opening.

8. The image-forming apparatus as claimed in claim 7, further comprising a pressing releasing member configured to move the developing pressing member from a pressing position to a non-pressing position in conjunction with movement of the cover from the closed position to the open position, the developing pressing member at the pressing position pressing the developing cartridge, the developing pressing member at the non-pressing position being disabled from pressing the developing cartridge.

9. The image-forming apparatus as claimed in claim 8, wherein the photosensitive drum is configured to move between an image-forming position at which image formation is allowed and a non-image-forming position at which image formation is disabled, the image-forming apparatus further comprising a drum guide configured to guide movement of the photosensitive drum between the image-forming position and the non-image-forming position.

10. The image-forming apparatus as claimed in claim 9, further comprising a linking member configured to move the photosensitive drum from the image-forming position to the non-image-forming position in conjunction with the movement of the cover from the closed position to the open position.

11. The image-forming apparatus as claimed in claim 10, wherein the linking member is configured to move between an engaging position engaging the photosensitive drum and a non-engaging position disengaged from the photosensitive drum, the linking member at the non-engaging position being positioned more outward in an axial direction of the photosensitive drum than the linking member at the engaging position.

12. The image-forming apparatus as claimed in claim 11, wherein:

the cover is further movable to an intermediate position between the closed position and the open position;

the pressing releasing member is configured to move the developing pressing member from the pressing position to the non-pressing position in conjunction with movement of the cover from the closed position to the intermediate position; and the linking member is configured to move the photosensitive drum from the image-forming position to the non-image-forming position in conjunction with movement of the cover from the intermediate position to the open position.

13. The image-forming apparatus as claimed in claim 11, further comprising:

a drum cartridge including the photosensitive drum; and another cover movably provided at the main casing, the main casing being further formed with another opening, the drum cartridge being inserted in and removed from the main casing through the other opening, the other cover being movable between another closed position closing the other opening and another open position opening the other opening.

14. The image-forming apparatus as claimed in claim 13, further comprising an exposure unit configured to expose a surface of the photosensitive drum, wherein the drum guide extends above the exposure unit and is connected to other opening, the photosensitive drum being configured to move from the image-forming position to the non-image-forming position while being guided along the drum guide toward the other opening.

15. The image-forming apparatus as claimed in claim 14, further comprising an urging member configured to urge the linking member toward the non-engaging position from the engaging position.

16. The image-forming apparatus as claimed in claim 15, wherein the other cover comprises a cam configured to allow and restrict urging of the urging member against the linking member, the cam of the other cover at the other open position allowing the urging member to urge the linking member to place the linking member at the non-engaging position, the cam of the other cover at the other closed position restricting the urging member from urging the linking member to place the linking member at the engaging position.

17. The image-forming apparatus as claimed in claim 13, further comprising a locking mechanism configured to move between a locking position locking the other cover at the other closed position and an unlocking position unlocking the other cover from the other closed position, the locking mechanism at the locking position locking the other cover at the other closed position while the cover is at the closed position, the locking mechanism moving from the locking position to the unlocking position in conjunction with the movement of the cover from the closed position to the open position.

18. An image-forming apparatus comprising:

a photosensitive drum;

an exposure unit configured to expose a surface of the photosensitive drum;

a developing cartridge including a developing roller, the developing cartridge being movable between a detachable position at which the developing cartridge is detachable from the image-forming apparatus and a contact position at which the developing roller is in contact with the photosensitive drum, the developing cartridge being further movable between the contact position and a separated position at which the developing roller is separated from the photosensitive drum, the developing cartridge being positioned higher when at the contact position than at the separated position;

a first developing guide configured to guide movement of the developing cartridge between the detachable position and the contact position;

a developing pressing member configured to press the developing cartridge in such a direction that the developing roller is pressed toward the photosensitive drum, the developing pressing member pressing the developing cartridge to place the developing cartridge at the contact position, the developing pressing member being disabled from pressing the developing cartridge to place the developing cartridge at the separated position; and a second developing guide configured to guide movement of the developing cartridge between the contact position and the separated position, wherein the first developing guide and the second developing guide are disposed below the exposure unit.

19. An image-forming apparatus comprising:

a photosensitive drum configured to move between an image-forming position at which image formation is allowed and a non-image-forming position at which image formation is disabled;

a drum guide configured to guide movement of the photosensitive drum between the image-forming position and the non-image-forming position;

a developing cartridge including a developing roller, the developing cartridge being movable between a detachable position at which the developing cartridge is detachable from the image-forming apparatus and a contact position at which the developing roller is in contact with the photosensitive drum, the developing cartridge being further movable between the contact position and a separated position at which the developing roller is separated from the photosensitive drum, the developing cartridge being positioned higher when at the contact position than at the separated position;

a main casing formed with an opening, the developing cartridge being inserted in and removed from the main casing through the opening; and a cover movably provided at the main casing, the cover being movable between a closed position closing the opening and an open position opening the opening;

a pressing releasing member configured to move the developing pressing member from a pressing position to a non-pressing position in conjunction with movement of the cover from the closed position to the open position, the developing pressing member at the pressing position pressing the developing cartridge, the developing pressing member at the non-pressing position being disabled from pressing the developing cartridge;

a linking member configured to move the photosensitive drum from the image-forming position to the non-image-forming position in conjunction with the movement of the cover from the closed position to the open position, wherein the linking member is configured to move between an engaging position engaging the photosensitive drum and a non-engaging position disengaged from the photosensitive drum, the linking member at the non-engaging position being positioned outward in an axial direction of the photosensitive drum than the linking member at the engaging position;

a first developing guide configured to guide movement of the developing cartridge between the detachable position and the contact position;

a developing pressing member configured to press the developing cartridge in such a direction that the developing roller is pressed toward the photosensitive drum, the developing pressing member pressing the developing cartridge to place the developing cartridge at the contact position, the developing pressing member being disabled from pressing the developing cartridge to place the developing cartridge at the separated position; and a second developing guide configured to guide movement of the developing cartridge between the contact position and the separated position.

* * * * *